US012501978B2

(12) United States Patent
Liang

(10) Patent No.: US 12,501,978 B2
(45) Date of Patent: Dec. 23, 2025

(54) WALLET WITH ANTI-LOST CARD

(71) Applicant: Yusheng Liang, Gaozhou (CN)

(72) Inventor: Yusheng Liang, Gaozhou (CN)

( * ) Notice: Subject to any disclaimer, the term of this patent is extended or adjusted under 35 U.S.C. 154(b) by 0 days.

(21) Appl. No.: 18/429,393

(22) Filed: Jan. 31, 2024

(65) Prior Publication Data

US 2024/0398081 A1 Dec. 5, 2024

Related U.S. Application Data

(63) Continuation-in-part of application No. 18/204,960, filed on Jun. 2, 2023, now Pat. No. 12,256,818.

(51) Int. Cl.
*A45C 13/18* (2006.01)
*A45C 1/06* (2006.01)
*A45C 13/00* (2006.01)

(52) U.S. Cl.
CPC ..... *A45C 13/185* (2013.01); *A45C 2001/065* (2013.01); *A45C 13/002* (2013.01)

(58) Field of Classification Search
CPC ..... A45C 13/185; A45C 13/002; A45C 2001/065
USPC ..... 150/134
See application file for complete search history.

(56) References Cited

U.S. PATENT DOCUMENTS 4,602,390 A * 7/1986 Morera ..... A41D 27/20 2/247
5,121,864 A * 6/1992 Geschwind ..... A45C 13/185 383/7
10,679,209 B2 * 6/2020 Tunnell ..... G06Q 20/363
2013/0319587 A1 * 12/2013 Chueh ..... A45C 1/06 150/132
2015/0206416 A1 * 7/2015 Marra ..... G08B 21/24 340/539.32
2016/0104151 A1 * 4/2016 Tunnell ..... G06Q 20/363 320/108
2016/0240075 A1 * 8/2016 Eisenman ..... G08B 13/1672
2018/0184775 A1 * 7/2018 Altschul ..... A45C 11/182
2021/0244145 A1 * 8/2021 Stewart, III ..... A45C 11/182
2021/0365927 A1 * 11/2021 Gupta ..... G06K 7/0065
2023/0389668 A1 * 12/2023 Zane ..... A45C 11/182

FOREIGN PATENT DOCUMENTS

TW M435186 U * 8/2012

OTHER PUBLICATIONS

Apple Support : "How to use Find My on iPhone and iPad" https://www.youtube.com/watch?v=Jzxhi3HRIjU (Year: 2023).*
Runbox—Airtag Wallet https://www.amazon.com/dp/B0D3PWS5GV (Year: 2022).*
Bosca: Front Pocket Wallet https://www.amazon.com/Bosca-Deluxe-Front-Pocket-Wallet/dp/B000099Q4Y (Year: 2015).*

* cited by examiner

*Primary Examiner* — Nathan J Jenness
*Assistant Examiner* — Justin Caudill
(74) *Attorney, Agent, or Firm* — Che-Yang Chen

(57) ABSTRACT

A wallet is provided with an anti-lost card, so as to facilitate the user to track the wallet by the anti-lost card, the anti-lost card can be detachably or permanently placed in a wallet body of the wallet. A positioning module of the anti-lost card can take advantage of existing network of devices, which work as crowdsourced beacons to ping each other in order to determine the location of the missing wallet, so that compatible electronic devices can use an app to identify the approximate location of the missing wallet.

11 Claims, 21 Drawing Sheets

WALLET WITH ANTI-LOST CARD

CROSS REFERENCE OF RELATED APPLICATION

This is a Continuation-In-Part application that claims the benefit of priority under 35 U.S.C. § 120 to a non-provisional application, application Ser. No. 18/204,960, filing date Jun. 2, 2023, which is incorporated herewith by reference in its entity.

BACKGROUND OF THE PRESENT INVENTION

Field of Invention

The present invention relates to the field of wallet, and more particularly to a wallet with accommodating pocket for anti-lost card.

Description of Related Arts

In daily life, people are often troubled by lost items, and thus the intelligent anti-lost tags have emerged. The smart anti-lost tag, also known as the anti-lost locator, is a device that can establish a location relationship with a specific object, and the user can find the specific object through the location association between the smart anti-lost tag and the specific object.

There are various types of smart anti-lost tags. According to their working principles, they can be divided into Bluetooth anti-lost tags, GPS anti-lost tags, RFID anti-lost tags, etc. Bluetooth anti-lost tags are currently widely used anti-lost tags, such as Apple's AIRTAG$^{SM}$ and Huawei's TAG$^{SM}$. For example, the AIRTAG$^{SM}$ emits a secure Bluetooth signal that can be detected by nearby devices on the "find" network, and the device that detects it can send the location of the AIRTAG$^{SM}$ to the user's end device.

However, the intelligent anti-lost tag has some problems in practical application. For example, in practical usage, people usually put the smart anti-lost tag in the bag, which contains many miscellaneous items. The smart anti-lost tag is usually small in size, and it is difficult to find it when it is placed in the bag. To find the anti-lost tag will become people's new troubles. And most packaging bags are not specially designed and configured to prevent the intelligent anti-lost tag from falling out through the openings, so that the intelligent anti-lost tags which are relatively small are easy to fall out of the packaging bag.

SUMMARY OF THE PRESENT INVENTION

The invention is advantageous in that it provides a wallet with accommodating pocket for anti-lost tag, wherein the wallet provides a solution for storing the anti-lost tag, so that the anti-lost tag is easy to find, and is not easy to fall out of the accommodating pocket of the anti-lost tag.

Another advantage of the present invention is to provide a wallet with accommodating pocket for anti-lost tag, wherein in some embodiments, the accommodating pocket for the anti-lost tag is provided with a pocket opening that is configured to facilitate the user to take out or place the anti-lost tag into the accommodating pocket.

Another advantage of the present invention is to provide a wallet with accommodating pocket for anti-lost tag, wherein in some embodiments, the accommodating pocket for the an anti-lost tag is detachably arranged on a wallet body, so as to facilitate the placement of the anti-lost tag.

Another advantage of the present invention is to provide a wallet with an anti-lost card, so as to facilitate the user to track the wallet by the anti-lost card which is detachably or permanently placed in the wallet body of the wallet.

Additional advantages and features of the invention will become apparent from the description which follows, and may be realized by means of the instrumentalitics and combinations particularly pointing out in the appended claims.

According to the present invention, the foregoing and other objects and advantages are attained by a wallet for an anti-lost tag comprising a wallet body and an accommodating pocket which is coupled on the wallet body for accommodating the anti-lost tag.

According to some embodiments, the accommodating pocket comprises a first pocket surface and a second pocket surface which is opposite to the first pocket surface, wherein a portion of the structure of the wallet body forms the first pocket surface, and the second pocket surface is joined to the first pocket surface to form an accommodating space.

According to some embodiments, the accommodating pocket has a pocket opening, and the pocket opening is arranged for allowing the anti-lost tag to enter and exit the accommodating pocket.

According to some embodiments, the pocket opening is a slit formed in the second pocket surface, and a length of the slit is greater than a diameter of the anti-lost tag.

According to some embodiments, the wallet further comprises a switch control mechanism which is disposed at the pocket opening to allow the pocket opening to be switched between a first state and a second state, wherein when the pocket opening is in the first state, the anti-lost tag is allowed to enter and exit the accommodating pocket through the pocket opening, and when the pocket opening is in the second state, the anti-lost tag is blocked from entering and exiting the accommodating pocket through the pocket opening.

According to some embodiments, the switch control mechanism comprises an elastic band which is disposed at the pocket opening, wherein when the pocket opening is in the first state, a size of the pocket opening expands, and when the pocket opening is in the second state, the size of the pocket opening contracts, a radial dimension of the pocket opening is smaller than a diameter of the anti-lost tag.

According to some embodiments, the second pocket surface comprises an outer edge part and an inner covering part located within the outer edge part, and the pocket opening is located at the outer edge part.

According to some embodiments, the second pocket surface comprises an outer edge part and an inner covering part located within the outer edge part, and the pocket opening is located in the inner covering part.

According to some embodiments, the switch control mechanism comprises a zipper installed at the pocket opening, wherein the pocket opening is opened in the first state and closed in the second state.

According to some embodiments, the switch control mechanism comprises a VELCRO$^{SM}$ element, i.e., hook and loop elements, installed at the pocket opening, wherein the pocket opening is opened in the first state and closed in the second state.

According to some embodiments, the wallet body comprises a first partition layer and a second partition layer, forming an interlayer space therebetween with an opening, wherein the first partition layer forms the first pocket surface, and the first and second pocket surfaces form the accommodating pocket for the anti-lost tag, wherein the accommodating pocket is communicated to the interlayer space, the opening of the interlayer space between the first and second partition layers forms the pocket opening of the accommodating pocket.

According to some embodiments, the wallet further comprises a switch control mechanism which is disposed at the pocket opening to allow the pocket opening to be switched between a first state and a second state, wherein when the pocket opening is in the first state, the anti-lost tag is allowed to enter and exit the accommodating pocket through the pocket opening, and when the pocket opening is in the second state, the anti-lost tag is blocked from entering and exiting the accommodating pocket through the pocket opening.

According to some embodiments, the accommodating pocket is structurally independent from the wallet body and is capable of being detachably assembled to the wallet body.

According to some embodiments, the wallet further comprises a VELCRO$^{SM}$ element installed between the accommodating pocket and the wallet body, and the accommodating pocket can be detachably assembled to the wallet body via the VELCRO$^{SM}$ element.

According to some embodiments, the wallet further comprises an elastic clip installed between the accommodating pocket and the wallet body, and the accommodating pocket is capable of being detachably assembled to the wallet body via the elastic clip.

According to some embodiments, the accommodating pocket has a pocket opening which is configured to allow the anti-lost tag to enter and exit the accommodating pocket.

According to some embodiments, the accommodating pocket comprises a visible window structure to allow the anti-lost tag accommodated in the accommodating pocket to be visible.

According to some embodiments, the visible window structure has a viewing window formed in the accommodating pocket.

According to some embodiments, the visible window structure further comprises a transparent cover placed on the viewing window.

According to some embodiments, the accommodating pocket has an accommodating space, a shape of the accommodating space is matched with a shape of the anti-lost tag.

According to another aspect, the prevent invention provides a wallet comprising a wallet body and an anti-lost card which is disposed in the wallet body for positioning a location of the wallet.

According to some embodiments, the wallet body has one or more interlayer spaces, wherein the anti-lost card is detachably disposed in one of the interlayer spaces.

According to some embodiments, an accommodating pocket is coupled to the wallet body, wherein the anti-lost card is disposed in the accommodating pocket.

According to some embodiments, the accommodating pocket is integrally formed on the wallet body, wherein the anti-lost card is permanently fixed and sealed in the accommodating pocket.

According to some embodiments, the anti-lost card comprises two electrical contacts, wherein the accommodating pocket has two holes aligned with the two electrical contacts respectively for exposing two electrical contacts, so as to allow an electrically charging device to electrically charge the anti-lost card.

According to some embodiments, the accommodating pocket has an accommodating space, wherein the anti-lost card has an interlayer space adjacent to the accommodating space, wherein the two holes are communicated to the interlayer space and the accommodating space, so as to allow the electrically charging device to be disposed in the interlayer space to electrically charge the anti-lost card.

According to some embodiments, the accommodating pocket comprises a first pocket surface formed by the wallet body and a second pocket surface which is joined to the first pocket surface to form an accommodating space for storing the anti-lost card.

According to some embodiments, the accommodating pocket has a pocket opening, and the pocket opening is arranged for allowing the anti-lost card to enter and exit the accommodating pocket.

According to some embodiments, the pocket opening is formed between upper parts of the first pocket surface and the second pocket surface.

According to some embodiments, the wallet body comprises a folding layer which is pivotally coupled to the accommodating pocket at a position corresponding to the pocket opening, wherein the folding layer is pulled out of the accommodating space for allowing the anti-lost card to be disposed in the accommodating space through the pocket opening, and then the folding layer is covered on an upper part of the anti-lost card to prevent the anti-lost card to slip off from the accommodating space.

According to some embodiments, a switch control mechanism is disposed at the pocket opening to allow the pocket opening to be switched between a first state and a second state, wherein when the pocket opening is in the first state, the anti-lost card is allowed to enter and exit the accommodating pocket through the pocket opening, and when the pocket opening is in the second state, the anti-lost card is blocked from entering and exiting the accommodating pocket through the pocket opening.

According to some embodiments, the switch control mechanism comprises an elastic band which is disposed at the pocket opening, wherein when the pocket opening is in the first state, a size of the pocket opening expands, and when the pocket opening is in the second state, the size of the pocket opening contracts.

According to some embodiments, in the wallet with the anti-lost card, the second pocket surface comprises an outer edge part and an inner covering part located within the outer edge part, and the pocket opening is located at the outer edge part.

According to some embodiments, in the wallet with the anti-lost card, the second pocket surface comprises an outer edge part and an inner covering part located within the outer edge part, and the pocket opening is located in the inner covering part.

According to some embodiments, in the wallet with the anti-lost card, a portion of the outer edge part of the second pocket surface is sewn to the first pocket surface, while another portion is not sewn to the first pocket surface, forming the pocket opening between the first pocket surface and the second pocket surface, wherein the clastic band is disposed at the another portion of the outer edge part of the second pocket surface.

According to some embodiments, in the wallet with the anti-lost card, the switch control mechanism comprises one of a zipper and a VELCRO$^{SM}$ element installed at the pocket opening, wherein the pocket opening is opened in the first state and closed in the second state.

According to some embodiments, in the wallet with the anti-lost card, the accommodating pocket is structurally independent from the wallet body and is capable of being detachably assembled to the wallet body.

According to some embodiments, the accommodating pocket comprises a transparent cover arranged on the accommodating pocket to allow the anti-lost card accommodated in the accommodating pocket to be visible, wherein the anti-lost card comprises an identification mark which is visible through the transparent cover, wherein the identification mark is a QR code arranged for providing contact information of owner of the wallet.

According to some embodiments, the anti-lost card comprises a card housing, a positioning module, and a battery module electrically connected to the positioning module, wherein the positioning module and the battery module is received in the card housing, wherein the positioning module is configured to allows an electric device to use Find My app to track the wallet.

According to some embodiments, the anti-lost card is programmed to be linked to a first electronic device and a second electronic device, wherein a first person of the first mobile electronic device is the owner of the wallet, so that the first person is allowed to use the first mobile electronic device to find the wallet, wherein a second person of the second mobile electronic device is allowed to have access to obtain information of the location of the wallet, so as to monitor and track the movement of the wallet, and thus information of the movement of the first person is obtained.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
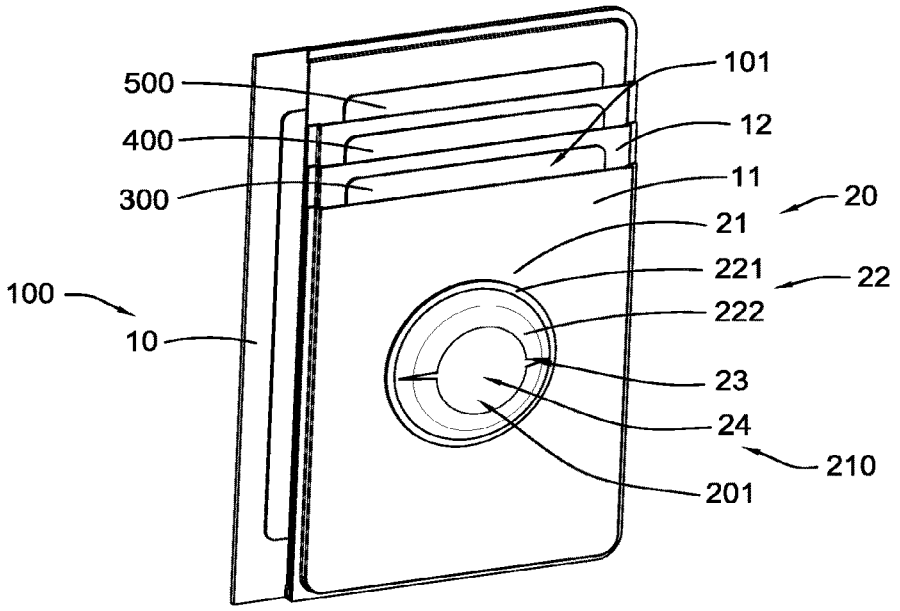
FIG. 1 is a perspective view of a wallet with accommodating pocket for anti-lost tag according to a first preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 18, a wallet 100 with an accommodating pocket 20 for an anti-lost tag 200 according to the present invention is illustrated, and the wallet 100 with the accommodating pocket 20 for the anti-lost tag 200 provides a solution for storing the anti-lost tag 200, so as to make the anti-lost tag 200 be easy to find and not easy to fall out of the accommodating pocket 20.

Specifically, the wallet 100 comprises a wallet body 10 and the accommodating pocket 20 which is disposed on the wallet body 10 for accommodating the anti-lost tag 200. The accommodating pocket 20 has an accommodating space 201, that is, the inner space of the accommodating pocket 20, the shape of the accommodating space 201 is matched with the shape of the anti-lost tag 200. Correspondingly, the size of the accommodating space 201 is slightly larger than that of the anti-lost tag 200, specifically, the inner diameter of the accommodating space 201 is slightly larger than the outer diameter of the anti-lost tag 200. For example, the anti-lost tag 200 can be implemented as a circular AIRTAG$^{SM}$, the shape of the accommodating space 201 of the accommodating pocket 20 is also circular, and the inner diameter of the accommodating space 201 is slightly larger than the outer diameter of the AIRTAG$^{SM}$, so that the AIRTAG$^{SM}$ can be just fitted into the accommodating space 201. The shape of the accommodating space 201 of the accommodating pocket 20 can also be other shapes, for example, quadrangular, triangular, drop-shaped and so on.

It is worth mentioning that, in the preferred embodiments of the present invention, optionally, a part of the structure of the wallet body 20, which forms a part of the accommodating pocket 20, forms the accommodating pocket 20 for the anti-lost tag 200 together with other structures. The accommodating pocket 20 is shown in FIGS. 1 to 14. Alternatively, the accommodating pocket 20 for the anti-lost tag 200 and the wallet body 20 are structurally independent from each other, as shown in FIGS. 15 to 18.

In the first preferred embodiment of the present invention, the accommodating pocket 20 for the anti-lost tag 200 comprises a first pocket surface 21 and a second pocket surface 22 which is opposite to the first pocket surface 21, and the second pocket surface 22 is joined with the first pocket surface 21, so that the accommodating space 201 is formed between the first pocket surface 21 and the second pocket surface 22. Correspondingly, in some embodiments of the present invention, a partial structure of the wallet body 10 forms the first pocket surface 21.

Figure 2:
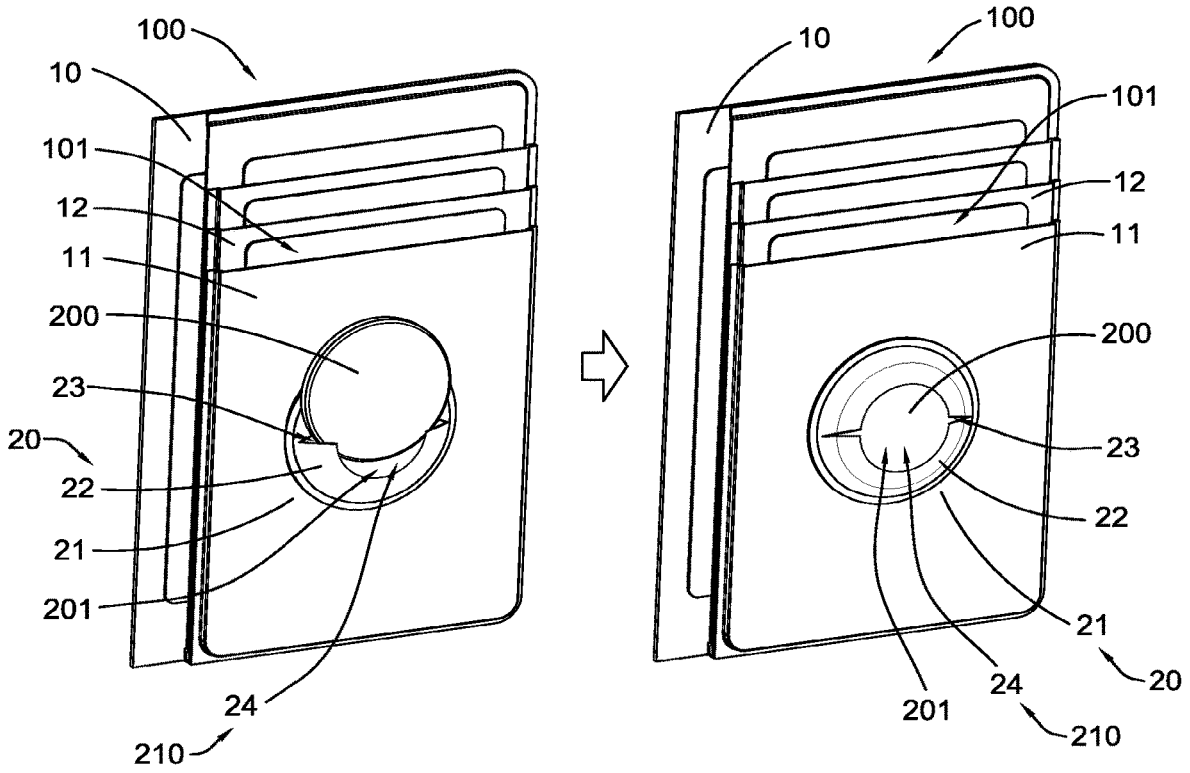
FIG. 2 is a perspective view illustrating an application scenario of the wallet with accommodating pocket for anti-lost tag according to the above first preferred embodiment of the present invention.
Figure 3:
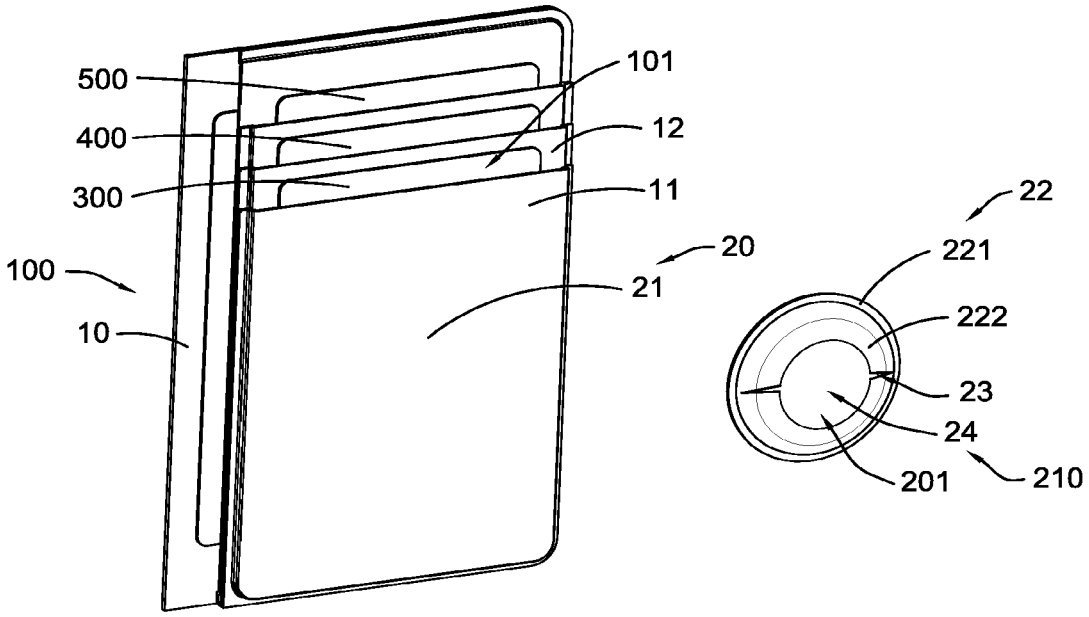
FIG. 3 is an exploded view of the wallet with accommodating pocket for anti-lost tag according to the above first preferred embodiment of the present invention.

Specifically, in some embodiments of the present invention, the wallet body 10 has at least one interlayer space 101 for accommodating specific objects, such as money, ID card 300, bank card 400, traffic card 500 and so on. The number of the interlayer spaces 101 is not limited in the present invention, for example, it may be one, two, three, or more. The wallet body 10 comprises at least two partition layers, namely, a first partition layer 11 and a second partition layer 12, and the interlayer space 101 is formed between every two adjacent partition layers. The first partition layer 11 can be used as the first pocket surface 21 of the accommodating pocket 2, as shown in FIGS. 1 to 3. The first partition layer 11 can be implemented as the innermost layer of the wallet 100 with the accommodating pocket 20, and a gap is formed between the first partition layer 11 and the second partition layer 12 to form the innermost interlayer space 101, as shown in FIG. 1. The first partition layer 11 can also be implemented as another layer of the wallet 100, for example, the first partition layer 11 can be the outer surface of the wallet 100, the outermost interlayer space 101 is formed between the first partition layer 11 and the second partition layer 12.

It is worth mentioning that important items, such as money, ID card 300, bank card 400, traffic card 500, etc., can be stored in the wallet 100. When the anti-lost tag 200 is used to find the wallet 100, the important items contained in the wallet 100 can also be found.

The accommodating pocket 20 for the anti-lost tag 200 can be implemented to have a fully enclosed cavity, or a cavity provided with an opening. Preferably, the accommodating pocket 20 for the anti-lost tag 200 is provided with a pocket opening 23, which facilitates the removal and placement of the anti-lost tag 200. In addition, it facilitates the removal of the anti-lost tag 200, and replaces the battery, or to facilitate the replacement of new anti-lost tag 20.

Correspondingly, in some embodiments of the present invention, the accommodating pocket 20 for the anti-lost tag 200 has a pocket opening 23, which is suitable for the anti-lost tag 200 to enter and exit the accommodating pocket 20

In some embodiments of the present invention, the pocket opening 23 has a specific structural configuration, which makes it difficult for the anti-lost tag 200 to fall out of the pocket opening 23.

In an example of the present invention, the pocket opening 23 is a slit formed in the second pocket surface 22. The length of the slit is greater than the diameter of the anti-lost tag 200, allowing the anti-lost tag 200 to be inserted into the accommodating pocket 20 through the slit. Due to the small width of the slit, which is much smaller than the outer diameter of the anti-lost tag 200, it is difficult for the anti-lost tag 200 to fall out of the slit without human intervention.

In this first preferred embodiment, the second pocket surface 22 comprises an outer edge part 221 adjacent to its outer peripheral edge and an inner covering part 222 located within the outer edge part 221. The inner covering part 222 of the second pocket surface 22 is protruded from the first pocket surface 21 and covers the anti-lost tag 200. The outer edge part 221 is joined to the first pocket surface 21 and located around the anti-lost tag 200. Specifically, the outer edge part 221 of the second pocket surface 22 can be joined to the first pocket surface 21 by stitching, and the slit is formed in the inner covering part 222. The hardness of the accommodating pocket 20 adjacent to the slit is increased to prevent the anti-lost tag 200 from falling out of the slit.

It should be understood that the outer edge part 221 of the second pocket surface 22 can also be joined to the first pocket surface 21 in other ways, such as being integrally formed with the first pocket surface 21.

It is worth mentioning that in this first preferred embodiment, the accommodating pocket 20 for the anti-lost tag 200 has a visible window structure 210, allowing the anti-lost tag 200 accommodated in the accommodating pocket 20 to be visible. Specifically, the visible window structure 210 is formed in the inner covering part 222. The visible window structure 210 comprises a viewing window 24 formed in the accommodating pocket 20. In this example, the viewing window 24 is communicated to the slit, as shown in FIGS. 1 to 3. The shape of the viewing window 24 is not limited in the present invention, for example, it can be circular, quadrilateral, triangular, fan-shaped, or a specific cartoon pattern. The inner diameter of the viewing window 24 is smaller than the outer diameter of the anti-lost tag 200.

Figure 4:
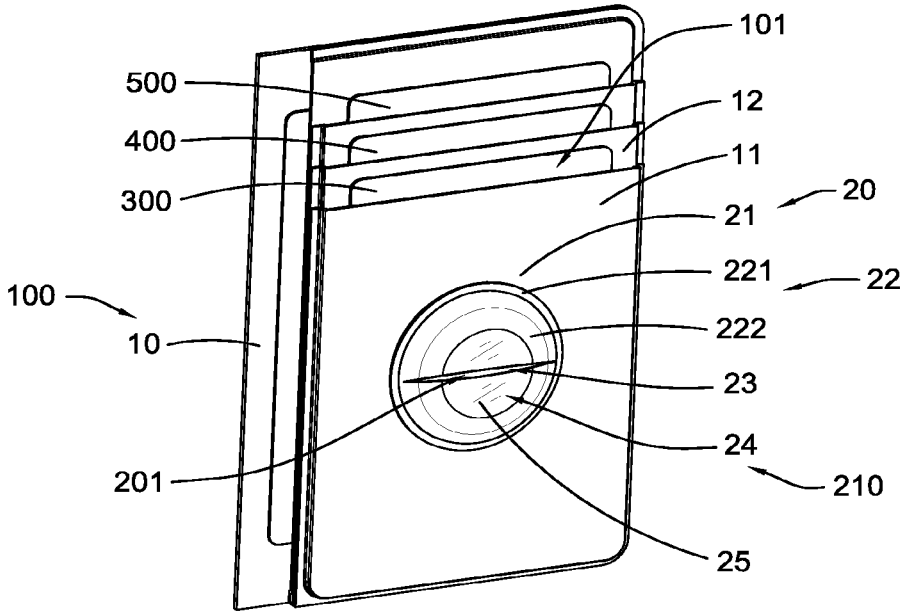
FIG. 4 is a perspective view of a wallet with accommodating pocket for anti-lost tag according to a second preferred embodiment of the present invention.

In a second preferred embodiment of the present invention, the visible window structure 210 further comprises a transparent cover 25 provided on the viewing window 24, as shown in FIG. 4.

Figure 5:
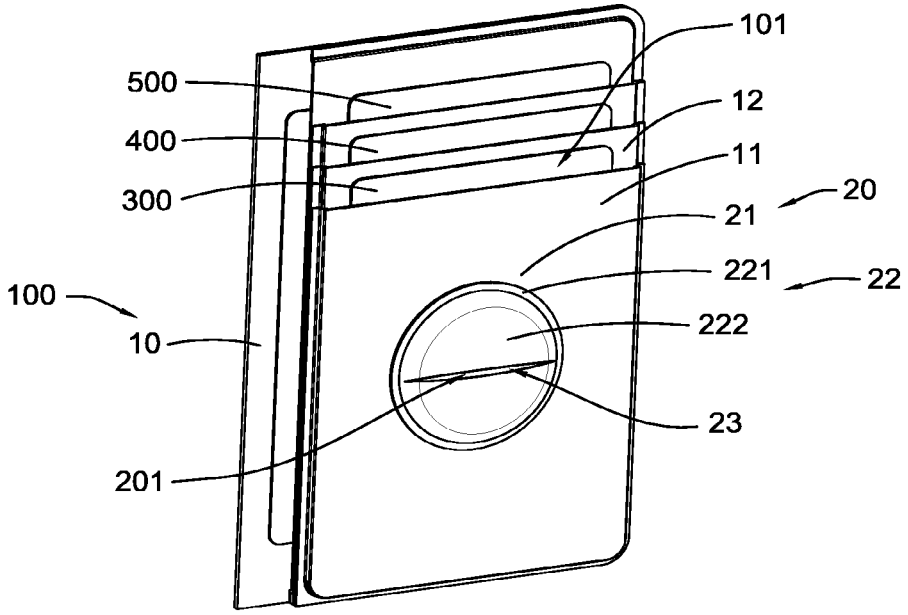
FIG. 5 is a perspective view of a wallet with accommodating pocket for anti-lost tag according to a third preferred embodiment of the present invention.

In a third preferred embodiment of the present invention, the accommodating pocket 20 may not be equipped with the visible window structure 210, as shown in FIG. 5.

The pocket opening 23 of the present invention can be configured with other structures to prevent the anti-lost tag 200 from falling out of the accommodating pocket 20. For example, the wallet 100 with the accommodating pocket 20 for the anti-lost tag 200 further comprises a switch control mechanism 26 disposed at the pocket opening 23, so that the pocket opening 23 can be switched between a first state and a second state. When the pocket opening 23 is in the first state, the anti-lost tag 200 is allowed to enter and exit, and when the pocket opening 23 is in the second state, the pocket opening 23 blocks the anti-lost tag 200 from entering and exiting.

Figure 6:
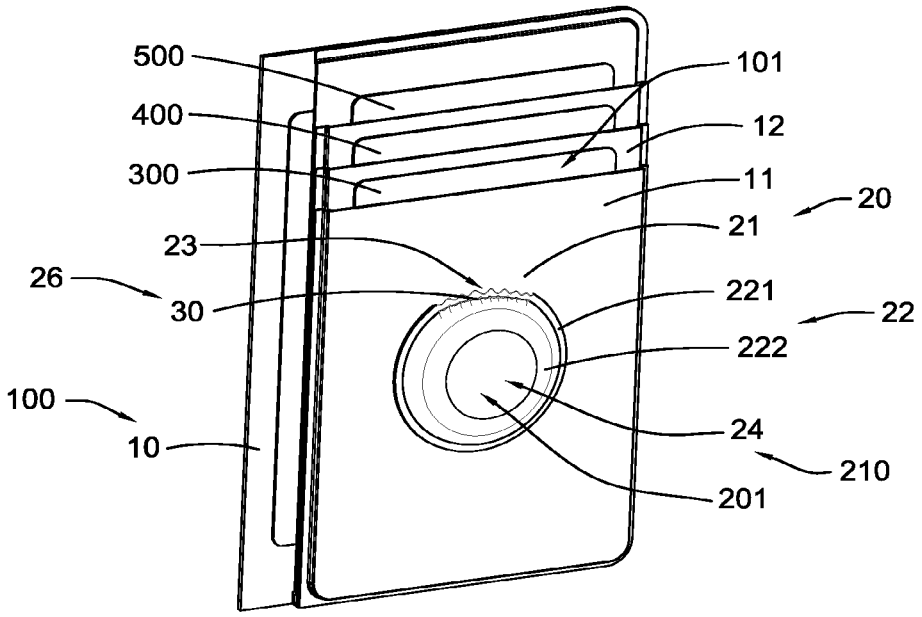
FIG. 6 is a perspective view of a wallet with accommodating pocket for anti-lost tag according to a fourth preferred embodiment of the present invention.

In a fourth preferred embodiment of the present invention, as shown in FIG. 6, the switch control mechanism 26 is implemented as an elastic band 30. Accordingly, the wallet 100 with the accommodating pocket 20 for the anti-lost tag 200 further comprises the elastic band 30 which is disposed at the pocket opening 23. When the pocket opening 23 is in the first state, the pocket opening 23 expands its size, and the radial size of the pocket opening 23 is greater than the diameter of the anti-lost tag 200. When the pocket opening 23 is in the second state, the pocket opening 23 contracts its size, and the radial size of the pocket opening 23 is smaller than the diameter of the anti-lost tag 200.

Figure 7:
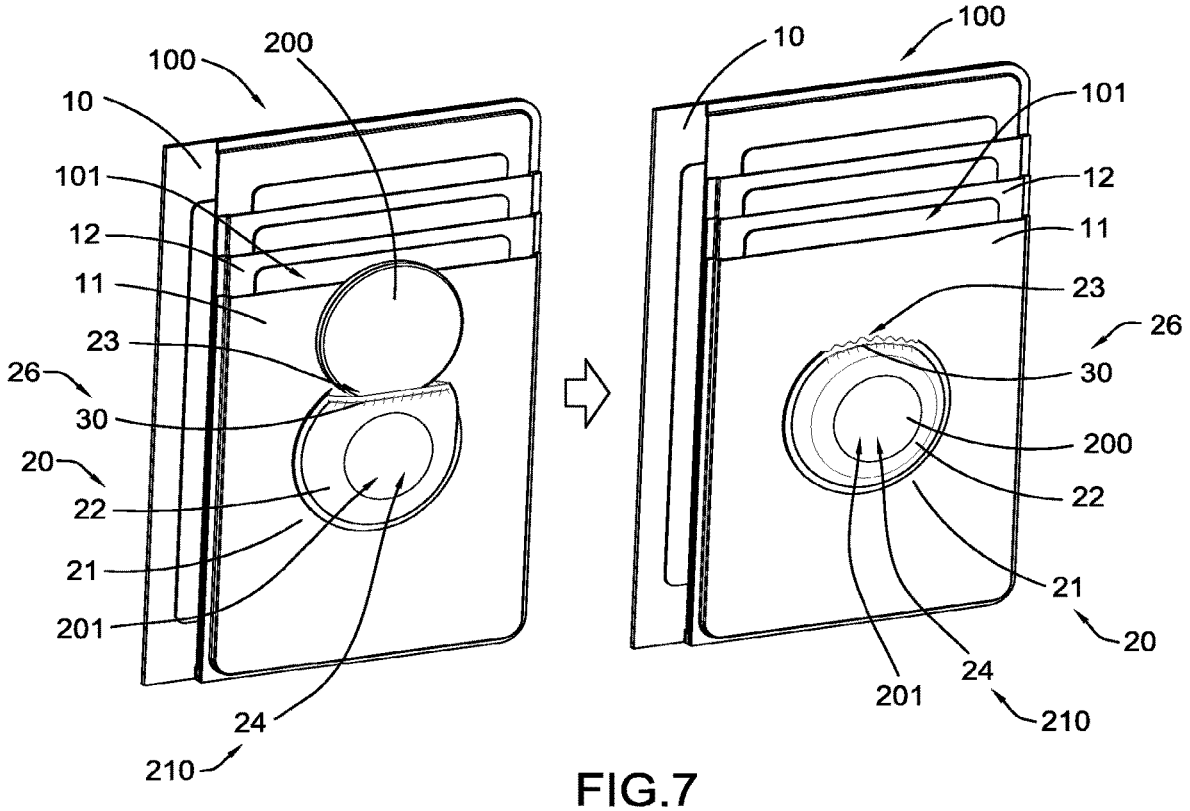
FIG. 7 is a perspective view illustrating an application scenario of the wallet with accommodating pocket for anti-lost tag according to the above fourth preferred embodiment of the present invention shown in FIG. 6.

In this example, the pocket opening 23 is located at the outer edge part 221 of the second pocket surface 22, as shown in FIG. 6. Specifically, a portion of the outer edge part 221 of the second pocket surface 22 is sewn to the first pocket surface 21, while another portion is not sewn to the first pocket surface 21, forming the pocket opening 23 between the two surfaces. The elastic band 30 is disposed at the unsewn portion of the outer edge part 221 of the second pocket surface 22. The elastic band 30 is in the initial state and in a contracted state, resulting in a smaller size of the pocket opening 23. When the pocket opening 23 is in the first state, the elastic band 30 is stretched from the initial state, and the pocket opening 23 expands its size. When the pocket opening 23 is in the second state, the elastic band 30 returns to the initial state, and the radial size of the pocket opening 23 is smaller than the diameter of the anti-lost tag 200, as shown in FIG. 7.

Figure 8:
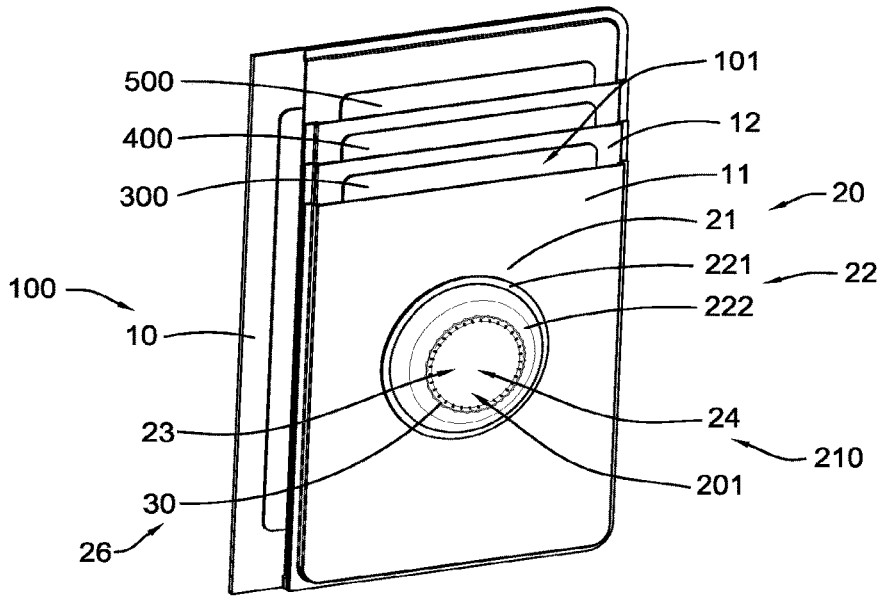
FIG. 8 is a perspective view of a wallet with accommodating pocket for anti-lost tag according to a fifth preferred embodiment of the present invention.

In a fifth preferred embodiment of the present invention, the switch control mechanism 26 is also implemented as the elastic band 30, and the pocket opening 23 is located in the inner covering part 222. In this example, the outer edge part 221 of the second pocket surface 22 is sewn together with the first pocket surface 21 in the circumferential direction. Specifically, the pocket opening 23 in the inner covering part 222 of the second pocket surface 22 is not only suitable for the anti-lost tag 200 to enter and exit, but also serves as a visible window structure 210 for the anti-lost tag 200, as shown in FIG. 8.

Figure 9:
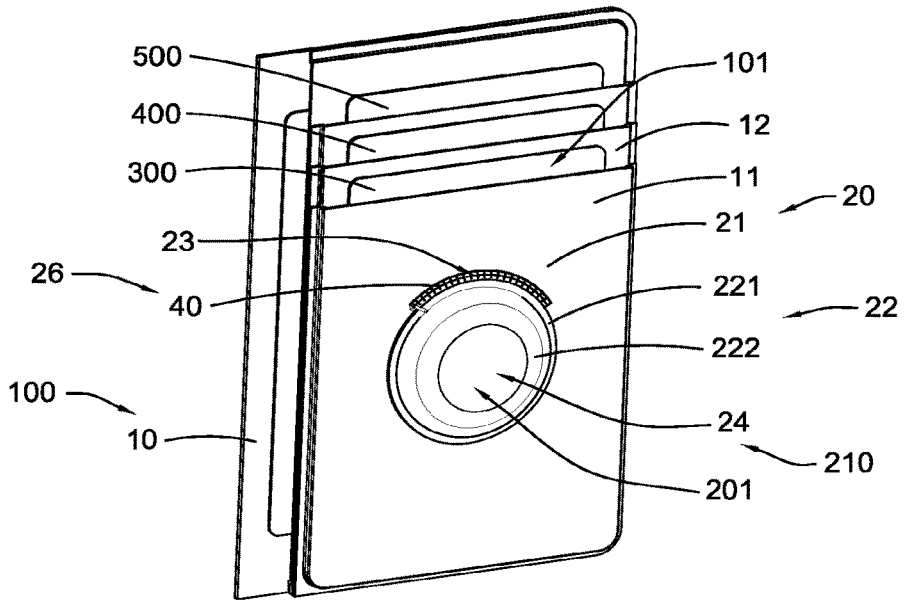
FIG. 9 is a perspective view of a wallet with accommodating pocket for anti-lost tag according to a sixth preferred embodiment of the present invention.
Figure 10:
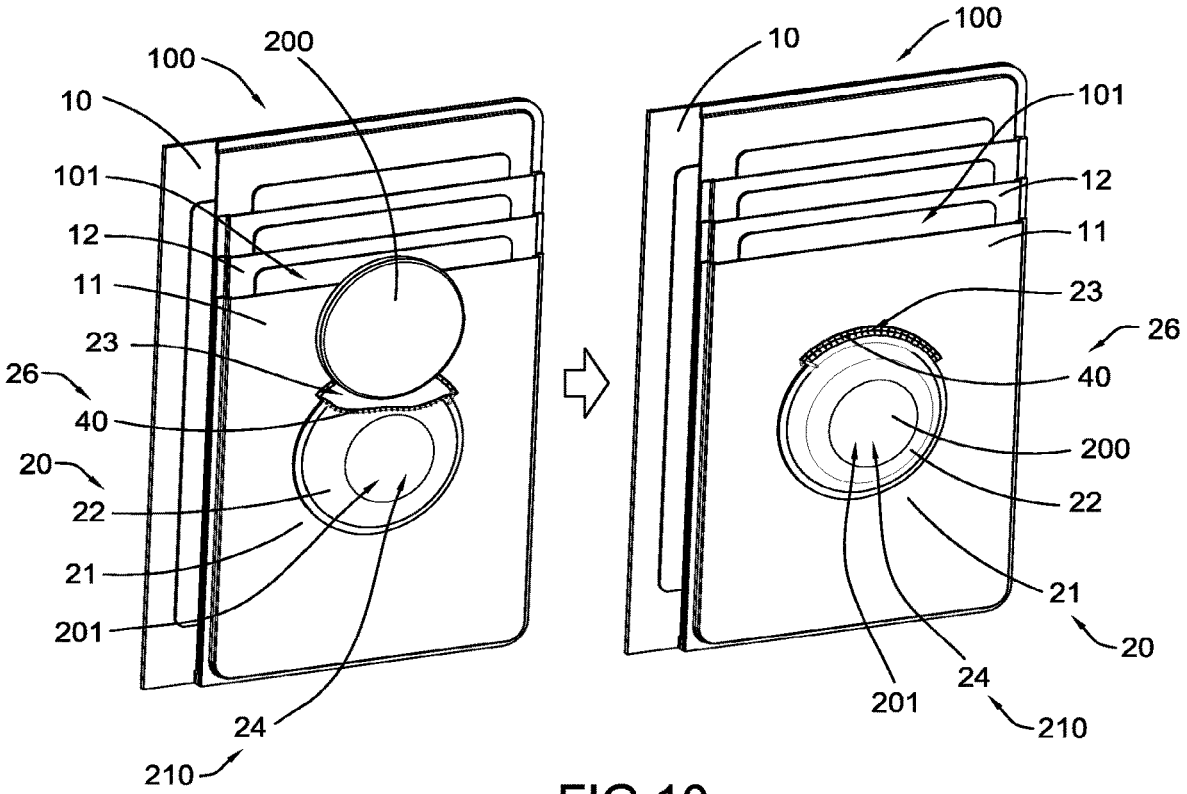
FIG. 10 is a perspective view illustrating an application scenario of the wallet with accommodating pocket for anti-lost tag according to the above sixth preferred embodiment of the present invention shown in FIG. 9.

In a sixth preferred embodiment of the present invention, the switch control mechanism 26 is also implemented as a zipper 40, as shown in FIGS. 9 and 10. Correspondingly, the wallet 100 with the accommodating pocket 20 for the anti-lost tag 200 also comprises the zipper 40 installed at the pocket opening 23. When the pocket opening 23 is in the first state, the zipper 40 is opened and the pocket opening 23 is opened accordingly. When the pocket opening 23 is in the second state, the zipper 40 is closed and the pocket opening 23 is closed accordingly.

Specifically, a partial area of the outer edge part 221 of the second pocket surface 22 is not sewn to the first pocket surface 21, forming the pocket opening 23. The zipper 40 is disposed between the partial area of the outer edge part 221 of the second pocket surface 22 and the first pocket surface 21, and can control the opening and closing of the pocket opening 23 while joining the second pocket surface 22 with the first pocket surface 21. Optionally, the zipper 40 is disposed between the entire outer edge part 221 of the second pocket surface 22 and the first pocket surface 21; or only disposed between the partial area of the outer edge part 221 of the second pocket surface 22 and the first pocket surface 21, and the part of the outer edge part 221 of the second pocket surface 22 that is not set with the zipper 40 can be joined with the first pocket surface 21 by sewing.

Figure 11:
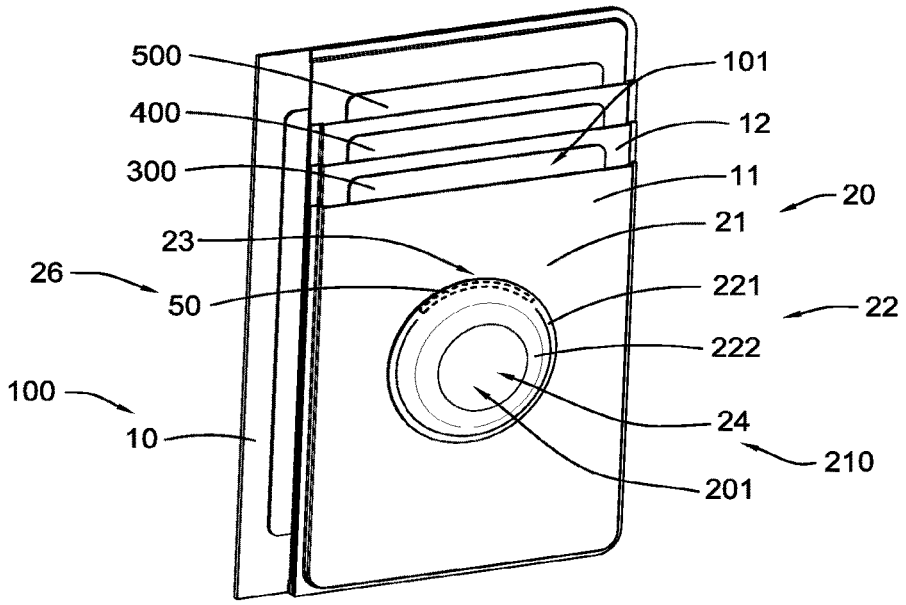
FIG. 11 is a perspective view of a wallet with accommodating pocket for anti-lost tag according to a seventh preferred embodiment of the present invention.
Figure 12:
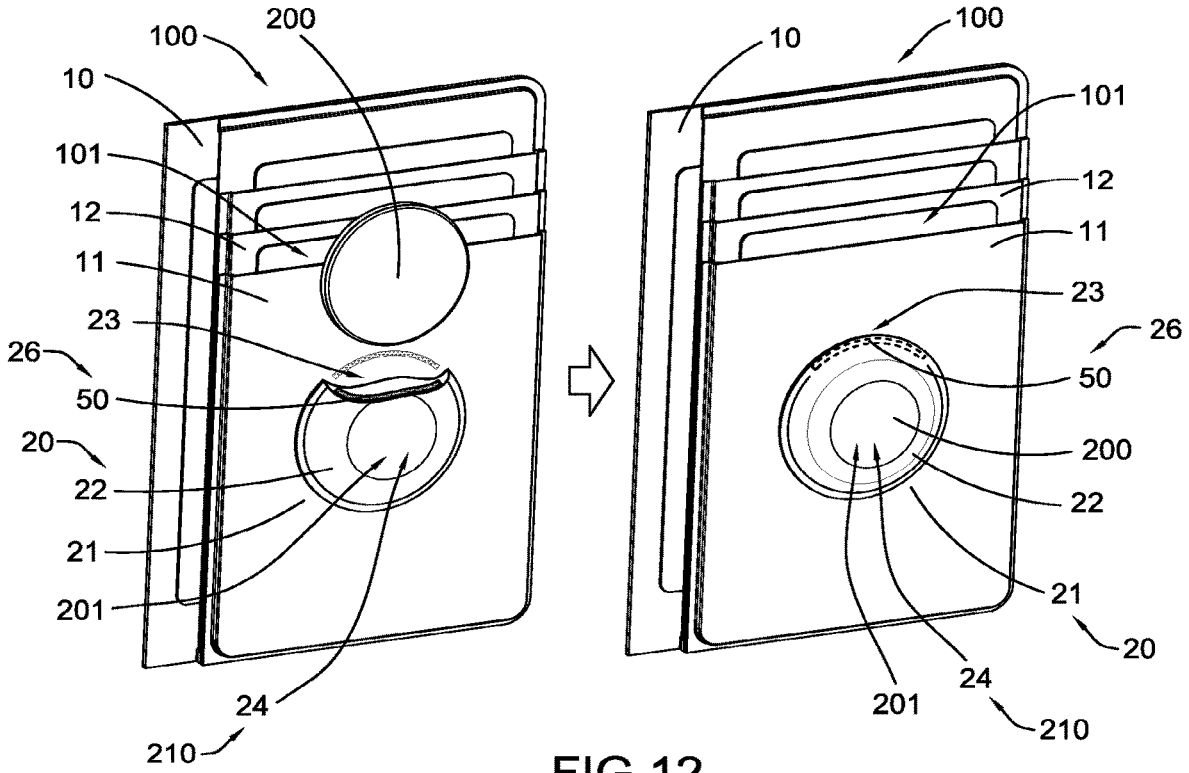
FIG. 12 is a perspective view illustrating an application scenario of the wallet with accommodating pocket for anti-lost tag according to the above seventh preferred embodiment of the present invention shown in FIG. 11.

In a seventh preferred embodiment of the present invention, the switch control mechanism 26 can be implemented as a VELCRO$^{SM}$ element 50, which is hook and loop elements as shown in FIGS. 11 and 12. Accordingly, the wallet 100 with the accommodating pocket 20 for the anti-lost tag 200 also comprises the VELCRO$^{SM}$ element 50 installed at the pocket opening 23. The VELCRO$^{SM}$ element 50 comprises a hook surface layer 51 and a fleece surface layer 52. The hook surface layer 51 comprises multiple hook structures, and the fleece surface layer 52 includes multiple fleece structures. The hook surface layer 51 and the fleece surface layer 52 are opposite to each other, and the hook structures are connected to the fleece structures after contact and can only be separated by an external force. The hook surface layer 51 is provided on the first pocket surface 21, and the fleece surface layer 52 is arranged on the second pocket surface 22, or the hook surface layer 51 is arranged on the second pocket surface 22, and the fleece surface layer 52 is provided on the first pocket surface 21. When the pocket opening 23 is in the first state, the hook surface layer 51 and the fleece surface layer 52 of the VELCRO$^{SM}$ element 50 are separated, and the pocket opening 23 is opened accordingly. When the pocket opening 23 is in the second state, the hook surface layer 51 and the fleece surface layer 52 of the VELCRO$^{SM}$ element 50 are in contact with each other and connected, and the pocket opening 23 is closed accordingly.

Specifically, a partial area of the outer edge part 221 of the second pocket surface 22 is not sewn to the first pocket surface 21, forming the pocket opening 23. The VELCRO$^{SM}$ element 50 is disposed between the partial area of the outer edge part 221 of the second pocket surface 22 and the first pocket surface 21, and the opening and closing of the pocket opening 23 can be controlled while the second pocket surface 22 is bonded with the first pocket surface 21. Optionally, the VELCRO$^{SM}$ element 50 is arranged between the entire outer edge part 221 of the second pocket surface 22 and the first pocket surface 21; or only disposed between the local outer edge part 221 of the second pocket surface 22 and the first pocket surface 21, and the part of the outer edge part 221 of the second pocket surface 22 without the VELCRO$^{SM}$ element 50 can be joined with the first pocket surface 21 by sewing.

It is worth mentioning that the accommodating pocket 20 for the anti-lost tag 200 can be communicated to the interlayer space 101. The opening of the interlayer space 101 can be used as the pocket opening 23 of the accommodating pocket 20, so that the anti-lost tag 200 can be taken out or placed into the accommodating pocket 20 through the opening of the interlayer space 101. Considering that the opening of the interlayer space 101 of the wallet body 10 with the accommodating pocket 200 for the anti-lost tag 200 is usually large, the anti-lost tag 200 may be easy to fall out from the opening of the interlayer space 101. Therefore, in the present invention, the switch control mechanism 26 is provided at the opening of the interlayer space 101 to prevent the anti-lost tag 200 from easily falling out from the opening of the interlayer space 101.

Figure 13:
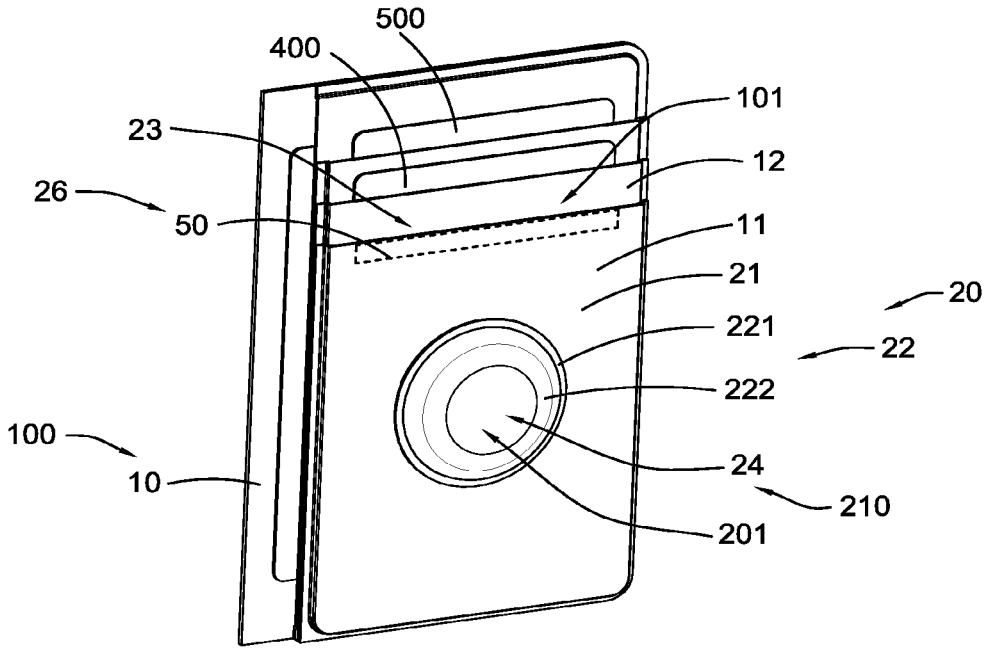
FIG. 13 is a perspective view of a wallet with accommodating pocket for anti-lost tag according to an eighth preferred embodiment of the present invention.
Figure 14:
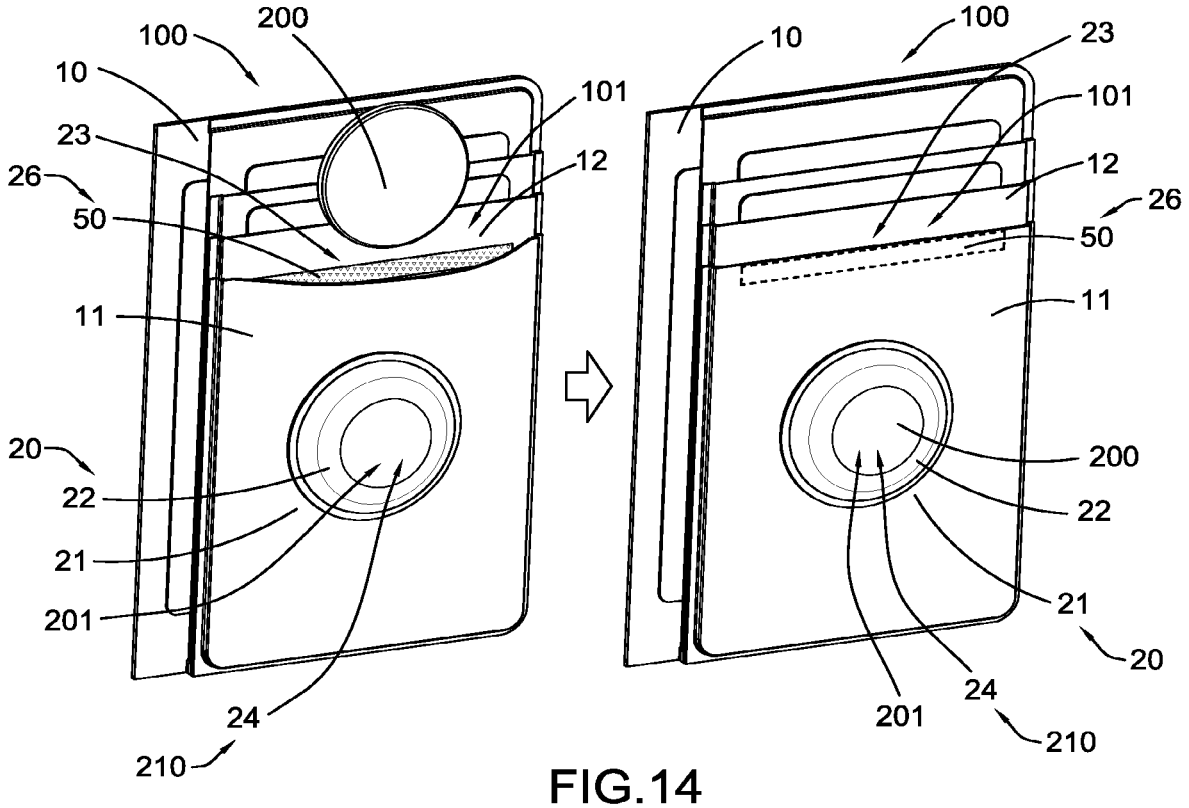
FIG. 14 is an exploded view of the wallet with accommodating pocket for anti-lost tag according to the above eighth preferred embodiment of the present invention shown in FIG. 13.
Figure 15:
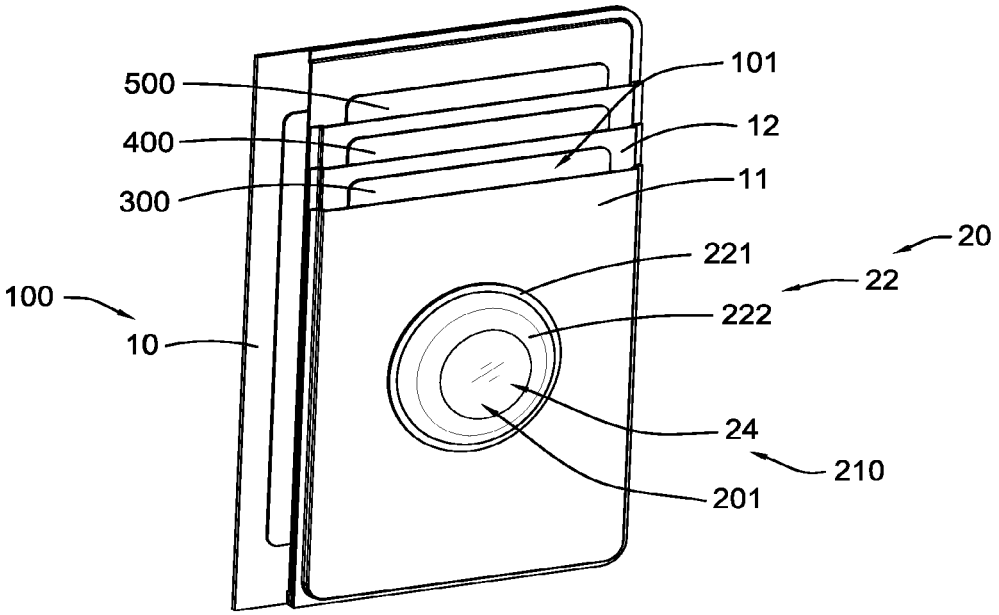
FIG. 15 is a perspective view of a wallet with accommodating pocket for anti-lost tag according to a ninth preferred embodiment of the present invention.

Correspondingly, as shown in FIGS. 13 and 14 of the drawings, in an eighth preferred embodiment of the present invention, an interlayer space 101 is formed between the first partition layer 11 and the second partition layer 12, and there is a gap between the upper edge parts of the first partition layer 11 and the second partition layer 12, forming an opening of the interlayer space 101. The first partition layer 11 is used as the first pocket surface 21 of the accommodating pocket 20, and the outer edge part 221 of the second pocket surface 22 is sewn around the first pocket surface 21 which is also the first partition layer 11. The second pocket surface 22 can also be joined with the first pocket surface 21 in other ways, for example, the outer edge part 221 of the second pocket surface 22 is integrally formed with the first pocket surface 21, and the inner covering part 222 of the second pocket surface 22 is protruded from the first pocket surface 21. The first pocket surface 21, that is, the first partition layer 11, has an opening corresponding to the inner covering part 222 of the second pocket surface 22, and the size of the opening is larger than the size of the anti-lost tag 200, so that the accommodating pocket 20 for the anti-lost tag is communicated to the interlayer space 101 formed between the first partition layer 11 and the second partition layer 12, and the opening of the interlayer space 101 formed between the first partition layer 11 and the second partition layer 12 is used as the pocket opening 23, so that the anti-lost tag 200 can reach the opening of the first partition layer 11 from the pocket opening 23 and enter the accommodating pocket 10.

The wallet 100 with the accommodating pocket for the anti-lost tag also comprises a switch control mechanism 26 installed at the pocket opening 23, i.e., between the first partition layer 11 and the second partition layer 12. The switch control mechanism 26 can be implemented as the VELCRO$^{SM}$ element 50, the zipper 40, the elastic band 30, etc. When the pocket opening 23 is in the first state, the hook surface layer 51 and the fleece surface layer 52 of the VELCRO$^{SM}$ element 50 are separated, and the pocket opening 23 opens accordingly. When the pocket opening 23 is in the second state, the hook surface layer 51 and the fleece surface layer 52 of the VELCRO$^{SM}$ element 50 come into contact and connect with each other, and the pocket opening 23 closes accordingly.

It should be understood that the switch control mechanism 26 can also be implemented as other structures, such as buttons, screws, threaded structures (for example, the internal thread is provided on the inner peripheral wall of the first pocket surface 21 and the external thread is arranged on the outer peripheral wall of the second pocket surface 22 corresponding to it), etc.

In some embodiments of the present invention, the accommodating pocket 20 for the anti-lost tag and the wallet body 10 are structurally independent from each other, and the accommodating pocket 20 for the anti-lost tag 200 can be detachably assembled on the wallet body 10, which is convenient for replacing the anti-lost tag 200, as shown in FIGS. 15 to 18. Specifically, the accommodating pocket 20 for the anti-lost tag 200 comprises a first pocket surface 21 and a second pocket surface 22 which is opposite to the first pocket surface 21, the pocket surfaces 21 and 22 are structurally independent with the wallet body 10, i.e., they are not formed by a portion of the structure of the wallet body 10. A detachable connecting element 60 is provided between the first pocket surface 21 and the wallet body 10, which allows the accommodating pocket 20 for the anti-lost tag 200 to be detachably assembled on the wallet body 10. In these embodiments, the accommodating pocket 20 for the anti-lost tag 200 can be implemented as a fully enclosed pocket or as a pocket with an opening.

Figure 16:
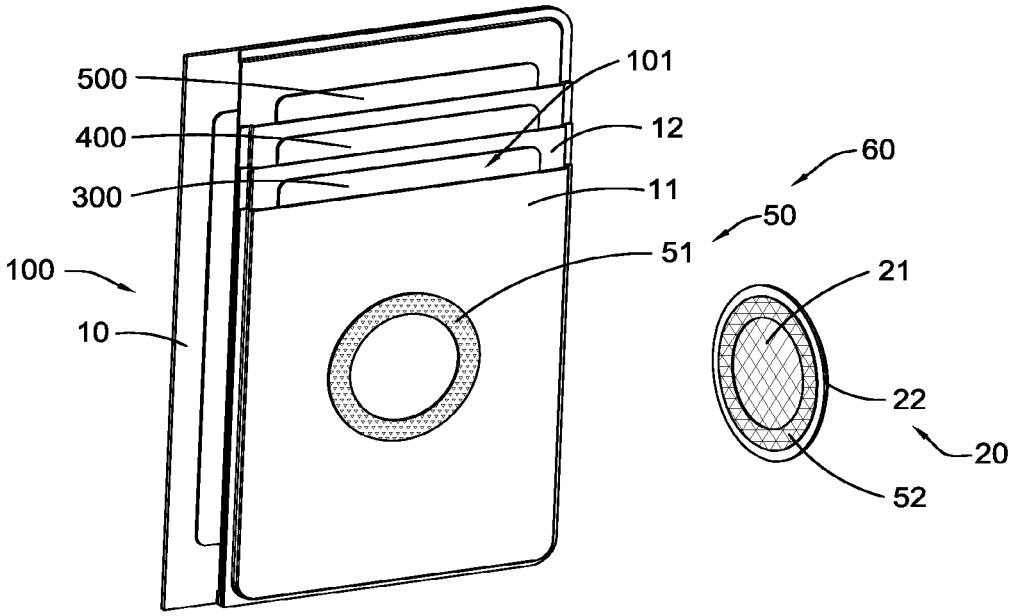
FIG. 16 is a perspective view of a wallet with accommodating pocket for anti-lost tag according to a tenth preferred embodiment of the present invention.

The accommodating pocket 20 for the anti-lost tag 200 is detachably assembled to the wallet body 10 in various embodiments not limited to the present invention. In one example of the present invention, the connecting element 60 between the accommodating pocket 20 for the anti-lost tag 200 and the wallet body 10 is implemented as the VELCRO$^{SM}$ element 50, as shown in FIG. 16. Correspondingly, in this tenth preferred embodiment of the present invention, the wallet 100 with the accommodating pocket for the anti-lost tag also comprises a VELCRO$^{SM}$ element 50 installed between the accommodating pocket 20 and the wallet body 10, and the accommodating pocket 20 for the anti-lost tag 200 is detachably assembled to the wallet body 10 through the VELCRO$^{SM}$ element 50. The VELCRO$^{SM}$ 50 element comprises a hook surface layer 51 and a fleece surface layer 52, where the hook surface layer 51 is arranged on the first pocket surface 21 and the fleece surface layer 52 is disposed on the wallet body 10, or the hook surface layer 51 is disposed on the wallet body 10 and the fleece surface layer 52 is arranged on the first pocket surface 21.

In this example, the entire outer edge part 221 of the second pocket surface 22 is sewn to the first pocket surface 21. In another embodiment of the present invention, the accommodating pocket 20 for the anti-lost tag 200 may also have a pocket opening 23 suitable for the anti-lost tag 200 to enter and exit.

Figure 17:
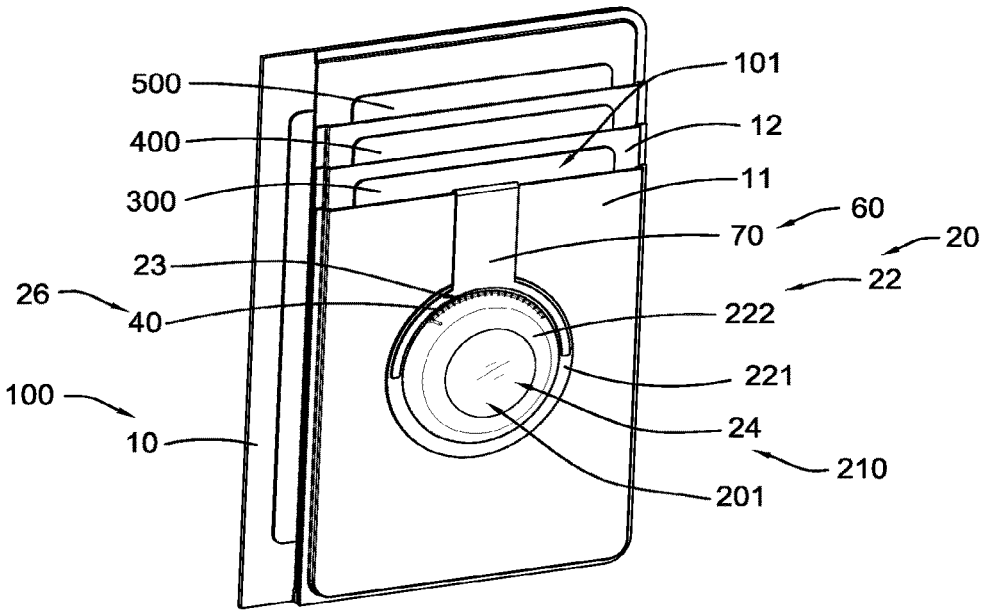
FIG. 17 is a perspective view of a wallet with accommodating pocket for anti-lost tag according to an eleventh preferred embodiment of the present invention.
Figure 18:
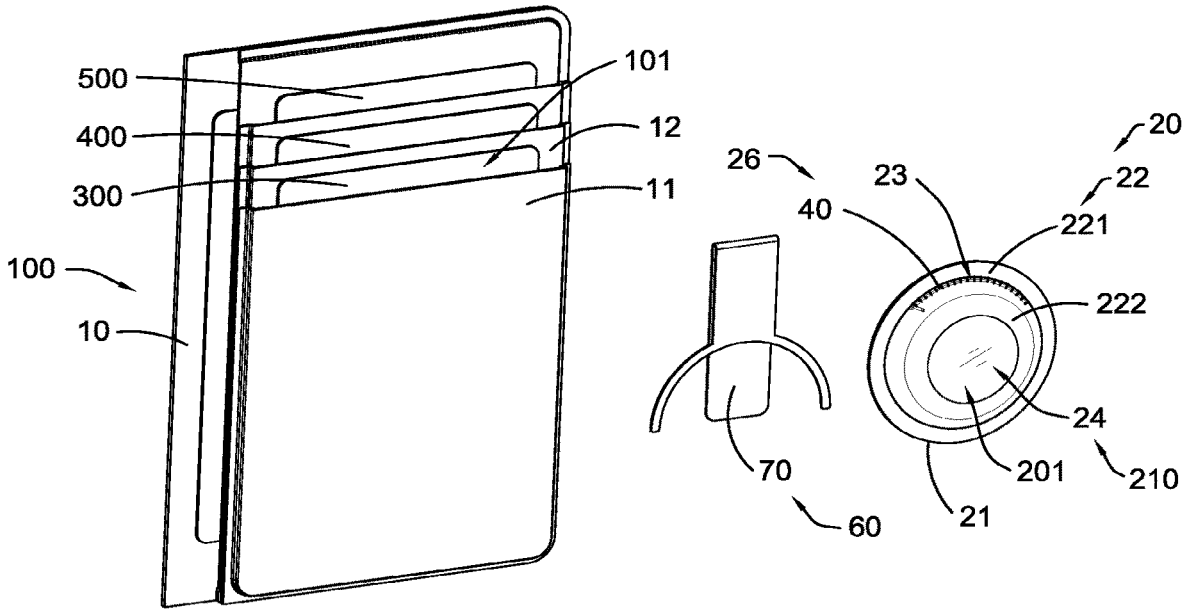
FIG. 18 is a perspective view of a wallet with accommodating pocket for anti-lost tag according to the above eleventh preferred embodiment of the present invention.

In an eleventh preferred embodiment of the present invention, the connecting element 60 between the anti-lost tag accommodating pocket 20 and the wallet body 10 is implemented as an elastic clip 70, as shown in FIGS. 17 and 18. Accordingly, in this example, the wallet 100 with the accommodating pocket 20 also comprises the elastic clip 70 installed between the accommodating pocket 20 and the wallet body 10, and the anti-lost tag accommodating pocket 20 can be detachably assembled to the wallet body 10 through the elastic clip 70. The elastic clip 70 comprises a first elastic piece and a second elastic piece, and the accommodating pocket 20 is fixed to the first clastic piece. The first elastic piece and the second elastic piece are integrally connected, and an adjustable gap is formed between the first elastic piece and the second elastic piece. When the first elastic piece and the second elastic piece move away from each other, at least one layer of the sandwiched surface of the wallet body 10 can be clamped into the adjustable gap; when the first elastic piece and the second elastic piece move closer to each other, the size of the adjustable gap decreases, and the first elastic piece and the second elastic piece clamp the sandwiched surface tightly, so that the anti-lost tag accommodating pocket 20 is installed on the wallet body 10. When the first elastic piece and the second elastic piece move away from each other, at least one layer of the sandwiched surface of the wallet body 10 can be detached from the adjustable gap, so that the anti-lost tag accommodating pocket 20 is detached from the wallet body 10.

In this example, the accommodating pocket 20 for the anti-lost tag 200 has a pocket opening 23, which is suitable for the anti-lost tag 200 to enter and exit the accommodating pocket 20.

It should be understood that the accommodating pocket 20 for the anti-lost tag 200 can also be detachably connected to the wallet body 10 in other ways, such as through straps, snap structures, threaded structures, etc., and is not limited to the present invention.

It is worth mentioning that in this embodiment of the present invention, the solution for storing the anti-lost tag 200 provided by the wallet 100 with the accommodating pocket 20 for the anti-lost tag 200 can also be applied to other types of bags, such as computer bags, backpacks, handbags, etc. In other words, the accommodating pocket 20 for the anti-lost tag 200 can be incorporated into other bag bodies in a manner similar to that of the wallet body 10, forming a receiving and storing bag with an accommodating pocket 20 for the anti-lost tag 200.

Referring to FIGS. 19 to 39, a wallet 100 with an anti-lost card 3 according to the present invention is illustrated, and the wallet 100 comprises a wallet body 10 and the anti-lost card 3 which is stored in the wallet body 10, so as to use the anti-lost card 3 to position and track the wallet body 10. In other words, the anti-lost card 3 is sold along with the wallet body 10, so that when a person buys the wallet 100, the anti-lost card 3 has already been placed in the wallet body 10.

The anti-lost card 3, which can be embodied to have a size like a credit card or a bank card, comprises a card housing 301, a positioning module 302, and a battery module 303 which is electrically connected to the positioning module 302. Accordingly, the area and size of the anti-lost card 3 can be larger than the AIRTAG$^{SM}$, so that the battery module 302 can have a larger size, and thus the anti-lost card 3 can be used for a relative long period of time with the electrical power supplied by the battery module 303.

In addition, the anti-lost card 3 also can be provided with other functions. For example, an RFID blocker module 304 can be integrated into the anti-lost card 3, so that the bank cards 400 stored in the wallet body 10 can be shielded by the RFID blocker module 304, and thus the bank cards 400 are protected from RFID chip readers, so as to ensure the anti-theft security.

Figure 20:
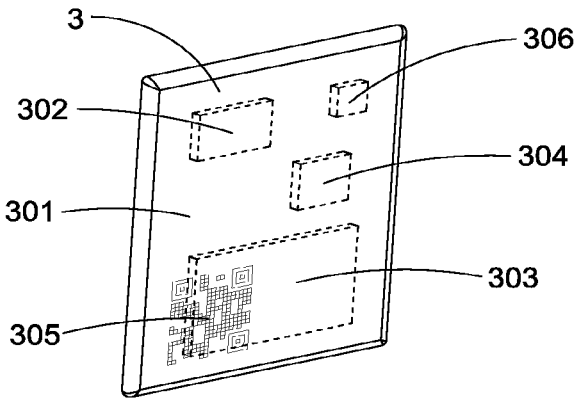
FIG. 20 is a perspective view of the anti-lost card of the wallet of the present invention.
Figure 21A:
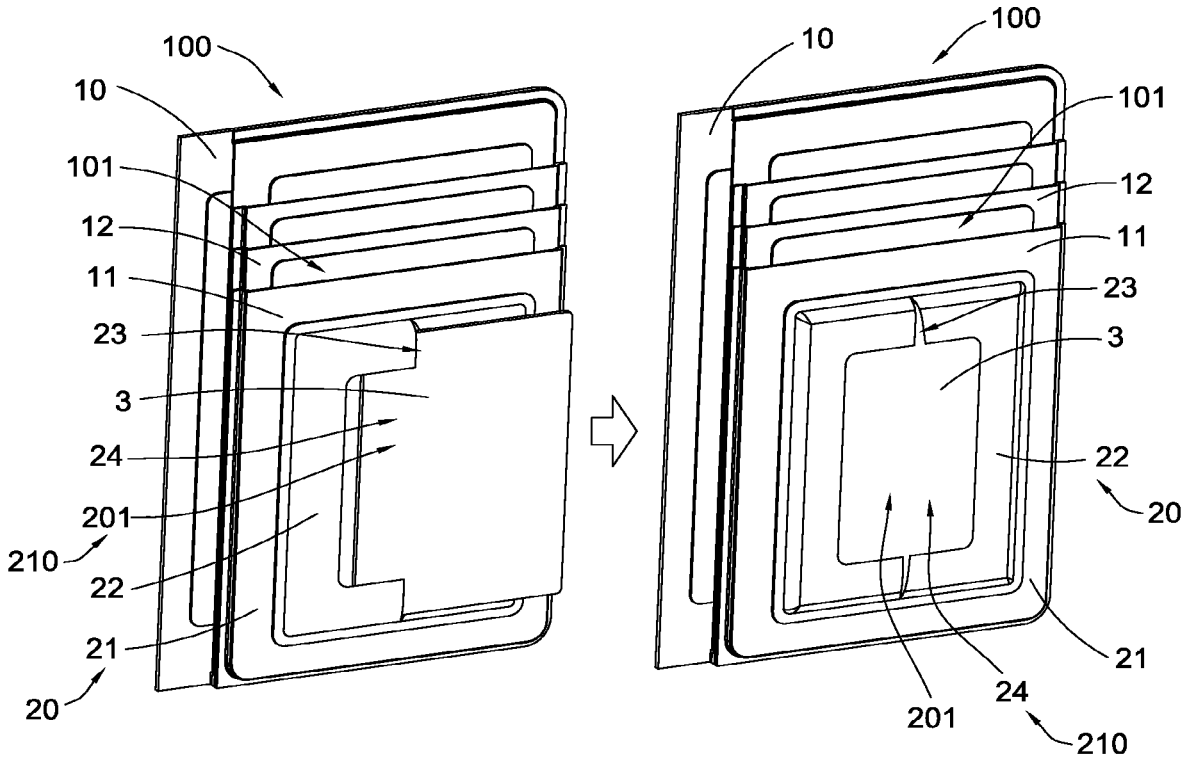
FIG. 21A is a perspective view illustrating an application scenario of the wallet with an anti-lost card according to the above twelfth preferred embodiment of the present invention.
Figure 21B:
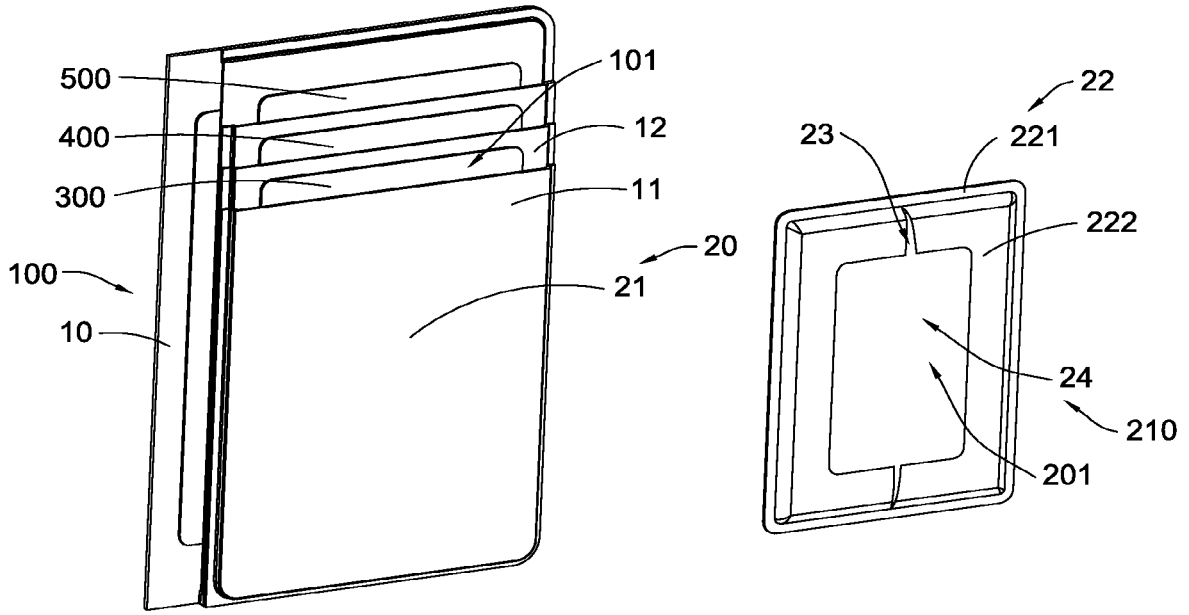
FIG. 21B is an exploded view of the wallet with an anti-lost card according to the above twelfth preferred embodiment of the present invention.

As shown in FIG. 20 of the drawings, an identification mark 305 can be formed on a surface of the card housing 301, so that when the owner of the wallet 100 lost the wallet 100, and the wallet 100 is picked up by another person, the identification mark 305 can be used for providing the contact information of the owner of the wallet 100, so that the person picking up the wallet 100 is able to return the wallet 100 to the owner. As an example, the identification mark 305 can be a QR code which can be scanned by a camera of a phone.

The positioning module 302 may be incorporated with a positioning chip like a GPS positioning chip. Alternatively, the positioning module 302 also functions like the AIRTAG$^{SM}$. More specifically, the positioning module 302 also use ultra-wideband technology and take advantage of Apple's existing network of devices, which work as crowd-sourced beacons to ping each other in order to determine the location of the missing wallet 100. Accordingly, compatible iPhones and iPads can use the Find My app to identify the approximate location of the missing wallet 100. The person of ordinary skilled in the art should understand that the Find My app of Apple is just an example and is not limiting, other existing network of mobile devices such as Android devices also can be used.

Similarly, the anti-lost card 3 also can be incorporated with an indicating member 306 which may produce an indicating sound or indicating light to indicate the location of wallet 100.

The positioning module 302 of the anti-lost card 3 may also be configured to collect and record the historical location information, so that when the wallet 100 is a gift to a child or an elder person. The anti-lost card 3 stored in the wallet body 10 is able to allow an guardian to monitor and track the movement of the child or the elder person.

In an embodiment, the anti-lost card 3 is programmed to be linked to two mobile electronic devices, a first person of a first mobile electronic device is the owner of the wallet 100 and the first person can use the first mobile electronic device to find the missing wallet 100. A second person of a second mobile electronic device is able to have access to the network to obtain the information of the location of the wallet 100, so as to monitor and track the movement of the wallet 100, and thus the information of the movement of the first person is obtained.

As shown in FIGS. 19 to 21B, the wallet 100 comprises a wallet body 10 and the accommodating pocket 20 which is disposed on the wallet body 10 for accommodating the anti-lost card 3. The accommodating pocket 20 has an accommodating space 201, that is, the inner space of the accommodating pocket 20, the shape of the accommodating space 201 is matched with the shape of the anti-lost card 3. Correspondingly, the size of the accommodating space 201 is slightly larger than that of the anti-lost card 3. For example, the anti-lost card 3 can be implemented as a rectangular card, the shape of the accommodating space 201 of the accommodating pocket 20 is also rectangular, and the area of the accommodating space 201 is slightly larger than the area of the anti-lost card 3, so that the anti-lost card 3 can be just fitted into the accommodating space 201. The shape of the accommodating space 201 of the accommodating pocket 20 can also be other shapes, for example, circular, quadrangular, triangular, drop-shaped and so on.

It is worth mentioning that, in the preferred embodiments of the present invention, optionally, a part of the structure of the wallet body 10, which forms a part of the accommodating pocket 20, forms the accommodating pocket 20 for the anti-lost card 300 together with other structures.

In the first preferred embodiment of the present invention, the accommodating pocket 20 for the anti-lost card 3 comprises a first pocket surface 21 and a second pocket surface 22 which is opposite to the first pocket surface 21, and the second pocket surface 22 is joined with the first pocket surface 21, so that the accommodating space 201 is formed between the first pocket surface 21 and the second pocket surface 22. Correspondingly, in some embodiments of the present invention, a partial structure of the wallet body 10 forms the first pocket surface 21.

Figure 19:
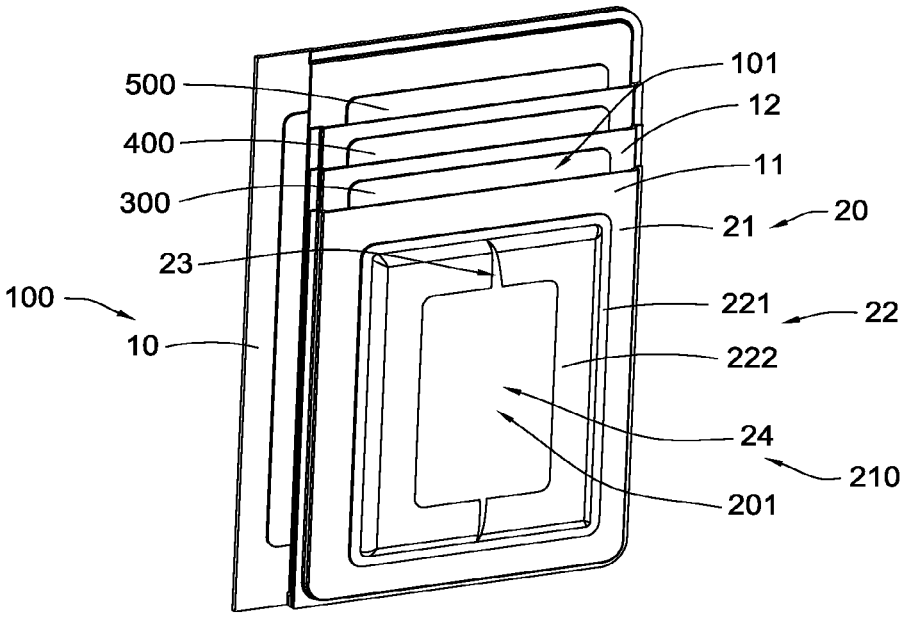
FIG. 19 is a perspective view of a wallet with an anti-lost card according to a twelfth preferred embodiment of the present invention.

Specifically, in some embodiments of the present invention, the wallet body 10 has at least one interlayer space 101 for accommodating specific objects, such as money, ID card 300, bank card 400, traffic card 500 and so on. The number of the interlayer spaces 101 is not limited in the present invention, for example, it may be one, two, three, or more. The wallet body 10 comprises at least two partition layers, namely, a first partition layer 11 and a second partition layer 12, and the interlayer space 101 is formed between every two adjacent partition layers. The first partition layer 11 can be used as the first pocket surface 21 of the accommodating pocket 20. The first partition layer 11 can be implemented as the innermost layer of the wallet 100 with the accommodating pocket 20, and a gap is formed between the first partition layer 11 and the second partition layer 12 to form the innermost interlayer space 101, as shown in FIG. 19. The first partition layer 11 can also be implemented as another layer of the wallet 100, for example, the first partition layer 11 can be the outer surface of the wallet 100, the outermost interlayer space 101 is formed between the first partition layer 11 and the second partition layer 12.

It is worth mentioning that important items, such as money, ID card 300, bank card 400, traffic card 500, etc., can be stored in the wallet 100. When the anti-lost card 3 is used to find the wallet 100, the important items contained in the wallet 100 can also be found.

The accommodating pocket 20 for the anti-lost card 3 can be implemented to have a fully enclosed cavity, or a cavity provided with an opening. Preferably, the accommodating pocket 20 for the anti-lost card 3 is provided with a pocket opening 23, which facilitates the removal and placement of the anti-lost card 3. In addition, it facilitates the removal of the anti-lost card 3, and replaces the battery, or to facilitate the replacement of new anti-lost card 30.

Correspondingly, in some embodiments of the present invention, the accommodating pocket 20 for the anti-lost card 3 has a pocket opening 23, which is suitable for the anti-lost card 3 to enter and exit the accommodating pocket 20.

In some embodiments of the present invention, the pocket opening 23 has a specific structural configuration, which makes it difficult for the anti-lost card 3 to fall out of the pocket opening 23.

In an example of the present invention, the pocket opening 23 is a slit formed in the second pocket surface 22. The length of the slit is greater than the length of the anti-lost card 3, allowing the anti-lost card 3 to be inserted into the accommodating pocket 20 through the slit. Due to the small width of the slit, which is much smaller than the width of the anti-lost card 3, it is difficult for the anti-lost card 3 to fall out of the slit without human intervention.

In this twelfth preferred embodiment, the second pocket surface 22 comprises an outer edge part 221 adjacent to its outer peripheral edge and an inner covering part 222 located within the outer edge part 221. The inner covering part 222 of the second pocket surface 22 is protruded from the first pocket surface 21 and covers the anti-lost card 3. The outer edge part 221 is joined to the first pocket surface 21 and located around the anti-lost card 3. Specifically, the outer edge part 221 of the second pocket surface 22 can be joined to the first pocket surface 21 by stitching, and the slit is formed in the inner covering part 222. The hardness of the accommodating pocket 20 adjacent to the slit is increased to prevent the anti-lost card 3 from falling out of the slit.

It should be understood that the outer edge part 221 of the second pocket surface 22 can also be joined to the first pocket surface 21 in other ways, such as being integrally formed with the first pocket surface 21.

It is worth mentioning that in this preferred embodiment, the accommodating pocket 20 for the anti-lost card 3 has a visible window structure 210, allowing the anti-lost card 3 accommodated in the accommodating pocket 20 to be visible. Specifically, the visible window structure 210 is formed in the inner covering part 222. The visible window structure 210 comprises a viewing window 24 formed in the accommodating pocket 20. In this example, the viewing window 24 is communicated to the slit, as shown in FIGS. 19 to 21B. The shape of the viewing window 24 is not limited in the present invention, for example, it can be circular, quadrilateral, triangular, fan-shaped, or a specific cartoon pattern. The inner diameter of the viewing window 24 is smaller than the width of the anti-lost card 3.

Figure 22:
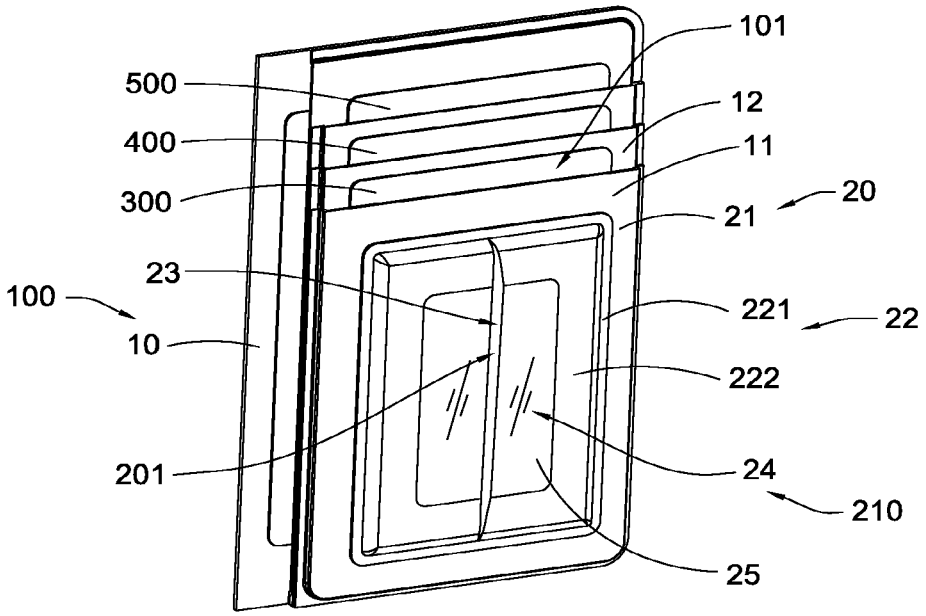
FIG. 22 is a perspective view of a wallet with an anti-lost card according to a thirteenth preferred embodiment of the present invention.

In a thirteenth preferred embodiment of the present invention, the visible window structure 210 further comprises a transparent cover 25 provided on the viewing window 24, as shown in FIG. 22.

Figure 23:
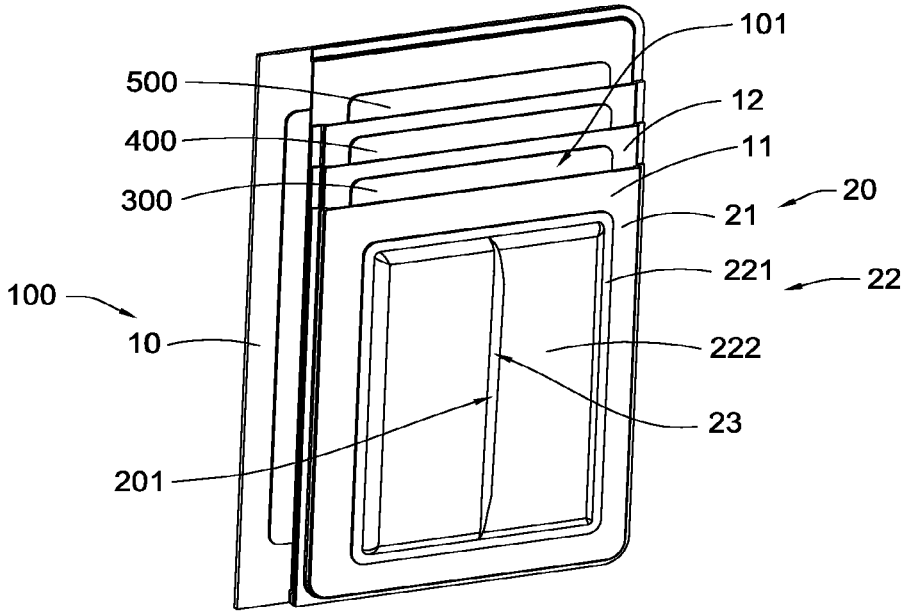
FIG. 23 is a perspective view of a wallet with accommodating pocket for anti-lost tag according to a fourteenth preferred embodiment of the present invention.

In a fourteenth preferred embodiment of the present invention, the accommodating pocket 20 may not be equipped with the visible window structure 210, as shown in FIG. 23.

The pocket opening 23 of the present invention can be configured with other structures to prevent the anti-lost card 3 from falling out of the accommodating pocket 20. For example, the wallet 100 with the accommodating pocket 20 for the anti-lost card 3 further comprises a switch control mechanism 26 disposed at the pocket opening 23, so that the pocket opening 23 can be switched between a first state and a second state. When the pocket opening 23 is in the first state, the anti-lost card 3 is allowed to enter and exit, and when the pocket opening 23 is in the second state, the pocket opening 23 blocks the anti-lost card 3 from entering and exiting.

Figure 24:
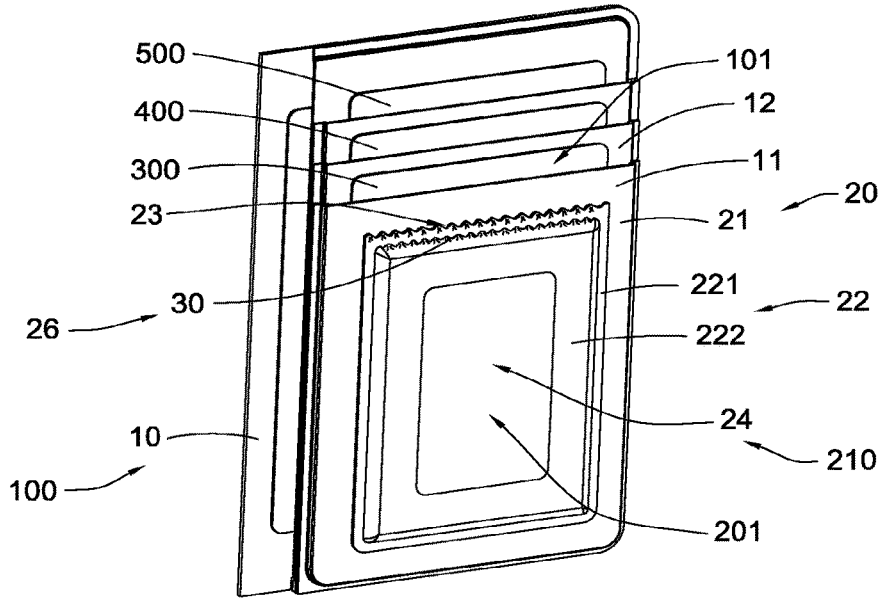
FIG. 24 is a perspective view of a wallet with an anti-lost card according to a fifteenth preferred embodiment of the present invention.
Figure 25:
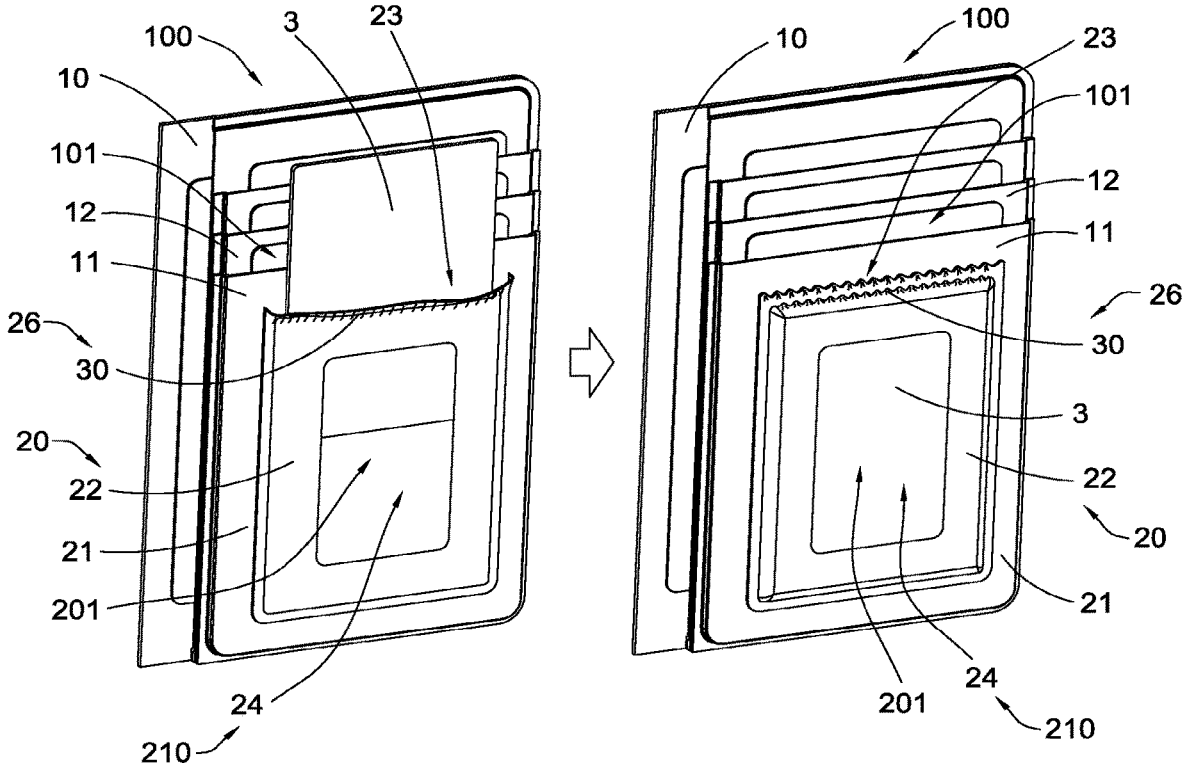
FIG. 25 is a perspective view illustrating an application scenario of the wallet with an anti-lost card according to the above fifteenth preferred embodiment of the present invention shown in FIG. 24.

In a fifteenth preferred embodiment of the present invention, as shown in FIG. 24 and FIG. 25, the switch control mechanism 26 is implemented as an elastic band 30. Accordingly, the wallet 100 with the accommodating pocket 20 for the anti-lost card 3 further comprises the elastic band 30 which is disposed at the pocket opening 23. When the pocket opening 23 is in the first state, the pocket opening 23 expands its size, and the radial size of the pocket opening 23 is greater than the width of the anti-lost card 3. When the pocket opening 23 is in the second state, the pocket opening 23 contracts its size, and the radial size of the pocket opening 23 is smaller than the width of the anti-lost card 3.

In this example, the pocket opening 23 is located at the outer edge part 221 of the second pocket surface 22, as shown in FIG. 24. Specifically, a portion of the outer edge part 221 of the second pocket surface 22 is sewn to the first pocket surface 21, while another portion is not sewn to the first pocket surface 21, forming the pocket opening 23 between the two surfaces. The elastic band 30 is disposed at the unsewn portion of the outer edge part 221 of the second pocket surface 22. The elastic band 30 is in the initial state and in a contracted state, resulting in a smaller size of the pocket opening 23. When the pocket opening 23 is in the first state, the elastic band 30 is stretched from the initial state, and the pocket opening 23 expands its size. When the pocket opening 23 is in the second state, the elastic band 30 returns to the initial state, and the radial size of the pocket opening 23 is smaller than the width of the anti-lost card 3, as shown in FIG. 25.

Figure 26:
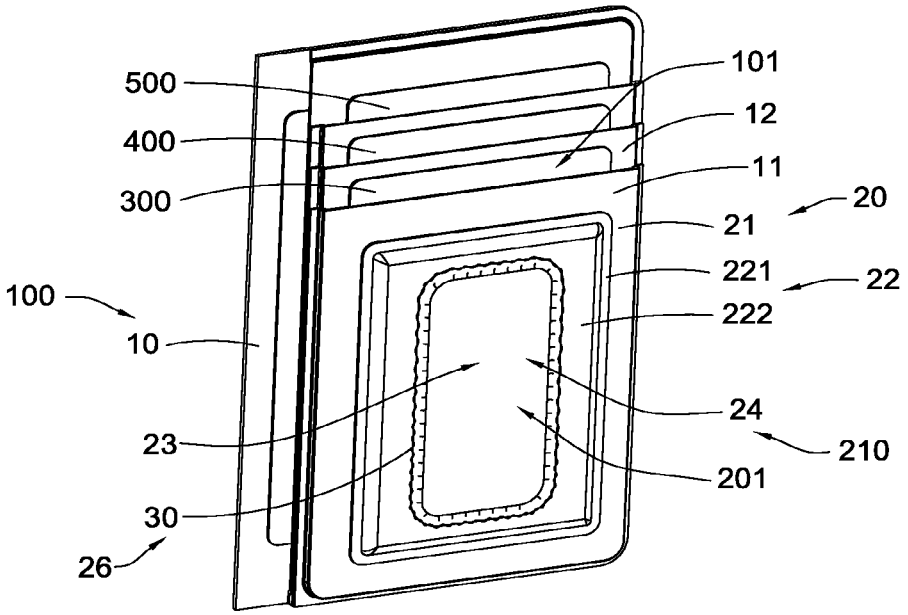
FIG. 26 is a perspective view of a wallet with an anti-lost card according to a sixteenth preferred embodiment of the present invention.

In a sixteenth preferred embodiment of the present invention, the switch control mechanism 26 is also implemented as the elastic band 30, and the pocket opening 23 is located in the inner covering part 222. In this example, the outer edge part 221 of the second pocket surface 22 is sewn together with the first pocket surface 21 in the circumferential direction. Specifically, the pocket opening 23 in the inner covering part 222 of the second pocket surface 22 is not only suitable for the anti-lost card 3 to enter and exit, but also serves as a visible window structure 210 for the anti-lost card 3, as shown in FIG. 26.

Figure 27:
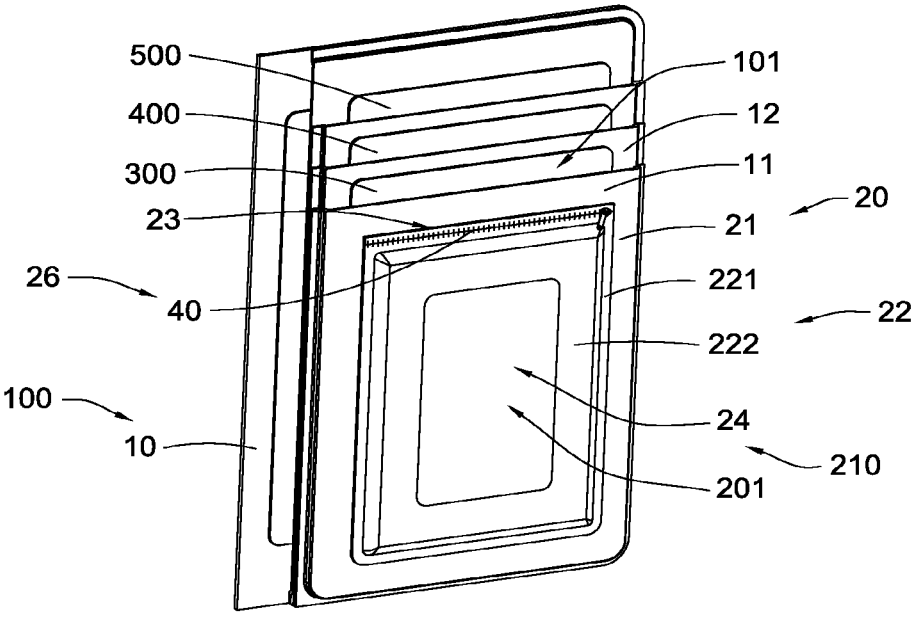
FIG. 27 is a perspective view of a wallet with an anti-lost card according to a seventeenth preferred embodiment of the present invention.
Figure 28:
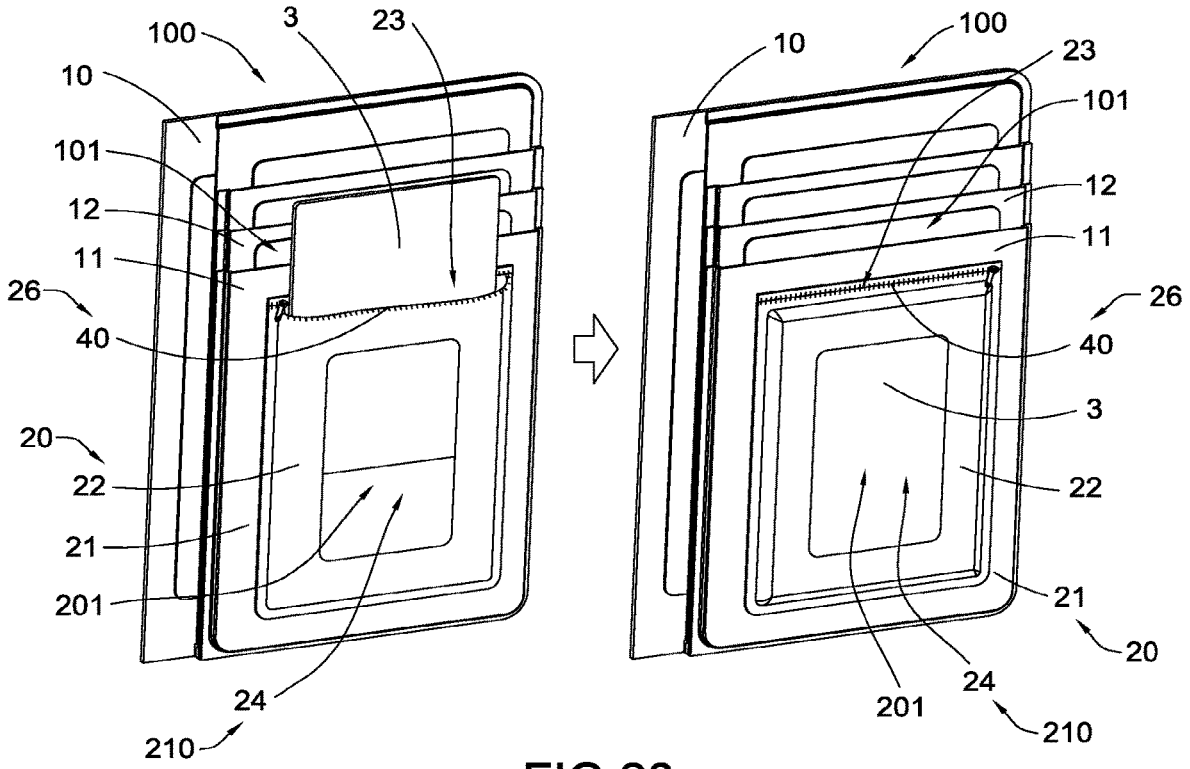
FIG. 28 is a perspective view illustrating an application scenario of the wallet with an anti-lost card according to the above seventeenth preferred embodiment of the present invention shown in FIG. 27.

In a seventeenth preferred embodiment of the present invention, the switch control mechanism 26 is also implemented as a zipper 40, as shown in FIGS. 27 and 28. Correspondingly, the wallet 100 with the accommodating pocket 20 for the anti-lost card 3 also comprises the zipper 40 installed at the pocket opening 23. When the pocket opening 23 is in the first state, the zipper 40 is opened and the pocket opening 23 is opened accordingly. When the pocket opening 23 is in the second state, the zipper 40 is closed and the pocket opening 23 is closed accordingly.

Specifically, a partial area of the outer edge part 221 of the second pocket surface 22 is not sewn to the first pocket surface 21, forming the pocket opening 23. The zipper 40 is disposed between the partial area of the outer edge part 221 of the second pocket surface 22 and the first pocket surface 21, and can control the opening and closing of the pocket opening 23 while joining the second pocket surface 22 with the first pocket surface 21. Optionally, the zipper 40 is disposed between the entire outer edge part 221 of the second pocket surface 22 and the first pocket surface 21; or only disposed between the partial area of the outer edge part 221 of the second pocket surface 22 and the first pocket surface 21, and the part of the outer edge part 221 of the second pocket surface 22 that is not set with the zipper 40 can be joined with the first pocket surface 21 by sewing.

Figure 29:
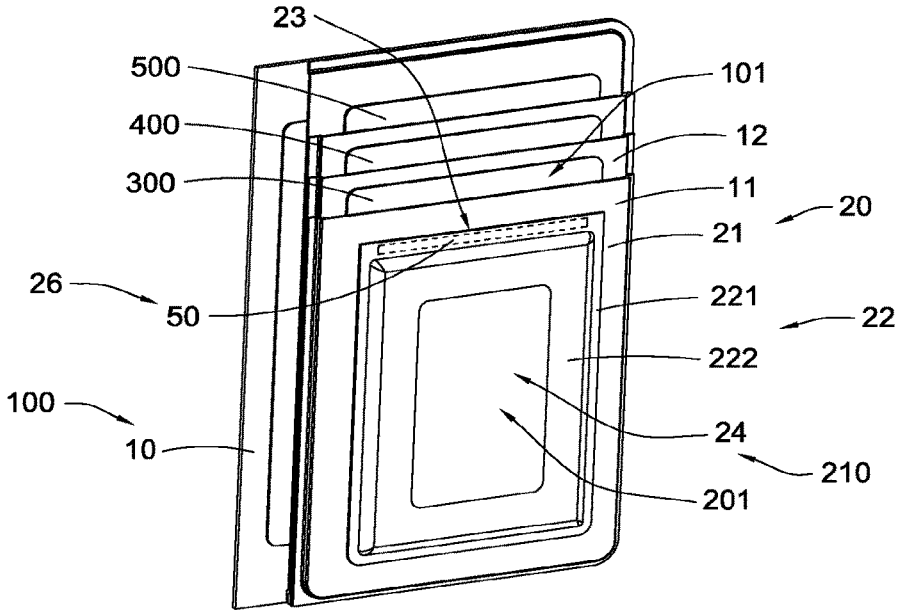
FIG. 29 is a perspective view of a wallet with an anti-lost card according to an eighteenth preferred embodiment of the present invention.
Figure 30:
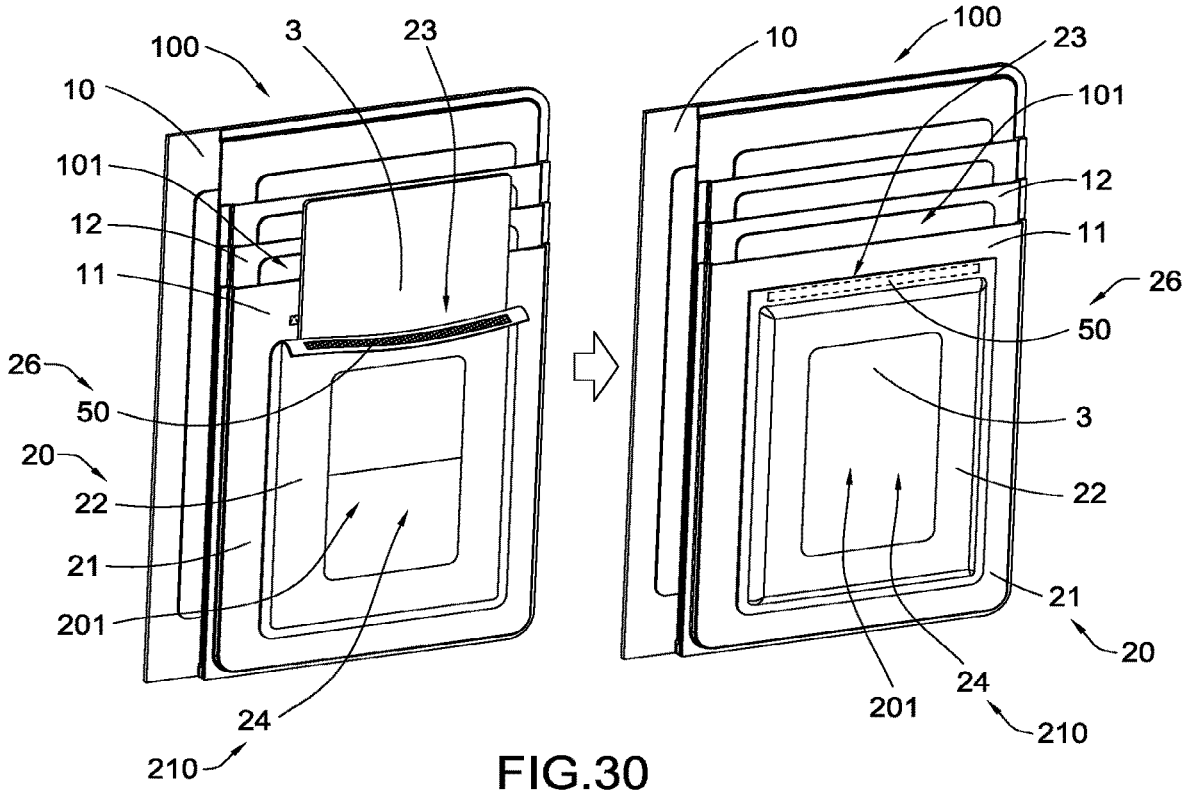
FIG. 30 is a perspective view illustrating an application scenario of the wallet with an anti-lost card according to the above eighteenth preferred embodiment of the present invention shown in FIG. 29.

In an eighteenth preferred embodiment of the present invention, the switch control mechanism 26 can be implemented as a VELCRO$^{SM}$ element 50, as shown in FIGS. 29 and 30. Accordingly, the wallet 100 with the accommodating pocket 20 for the anti-lost card 3 also comprises the VELCRO$^{SM}$ element 50 installed at the pocket opening 23. The VELCRO$^{SM}$ element 50 comprises a hook surface layer 51 and a fleece surface layer 52. The hook surface layer 51 comprises multiple hook structures, and the fleece surface layer 52 includes multiple fleece structures. The hook surface layer 51 and the fleece surface layer 52 are opposite to each other, and the hook structures are connected to the fleece structures after contact and can only be separated by an external force. The hook surface layer 51 is provided on the first pocket surface 21, and the fleece surface layer 52 is arranged on the second pocket surface 22, or the hook surface layer 51 is arranged on the second pocket surface 22, and the fleece surface layer 52 is provided on the first pocket surface 21. When the pocket opening 23 is in the first state, the hook surface layer 51 and the fleece surface layer 52 of the VELCRO$^{SM}$ element 50 are separated, and the pocket opening 23 is opened accordingly. When the pocket opening 23 is in the second state, the hook surface layer 51 and the fleece surface layer 52 of the VELCRO$^{SM}$ element 50 are in contact with each other and connected, and the pocket opening 23 is closed accordingly.

Specifically, a partial area of the outer edge part 221 of the second pocket surface 22 is not sewn to the first pocket surface 21, forming the pocket opening 23. The VELCRO$^{SM}$ element 50 is disposed between the partial area of the outer edge part 221 of the second pocket surface 22 and the first pocket surface 21, and the opening and closing of the pocket opening 23 can be controlled while the second pocket surface 22 is bonded with the first pocket surface 21. Optionally, the VELCRO$^{SM}$ element 50 is arranged between the entire outer edge part 221 of the second pocket surface 22 and the first pocket surface 21; or only disposed between the local outer edge part 221 of the second pocket surface 22 and the first pocket surface 21, and the part of the outer edge part 221 of the second pocket surface 22 without the VELCRO$^{SM}$ element 50 can be joined with the first pocket surface 21 by sewing.

It is worth mentioning that the accommodating pocket 20 for the anti-lost card 3 can be communicated to the interlayer space 101. The opening of the interlayer space 101 can be used as the pocket opening 23 of the accommodating pocket 20, so that the anti-lost card 3 can be taken out or placed into the accommodating pocket 20 through the opening of the interlayer space 101. Considering that the opening of the interlayer space 101 of the wallet body 10 with the accommodating pocket 200 for the anti-lost card 3 is usually large, the anti-lost card 3 may be easy to fall out from the opening of the interlayer space 101. Therefore, in the present invention, the switch control mechanism 26 is provided at the opening of the interlayer space 101 to prevent the anti-lost card 3 from easily falling out from the opening of the interlayer space 101.

Figure 31A:
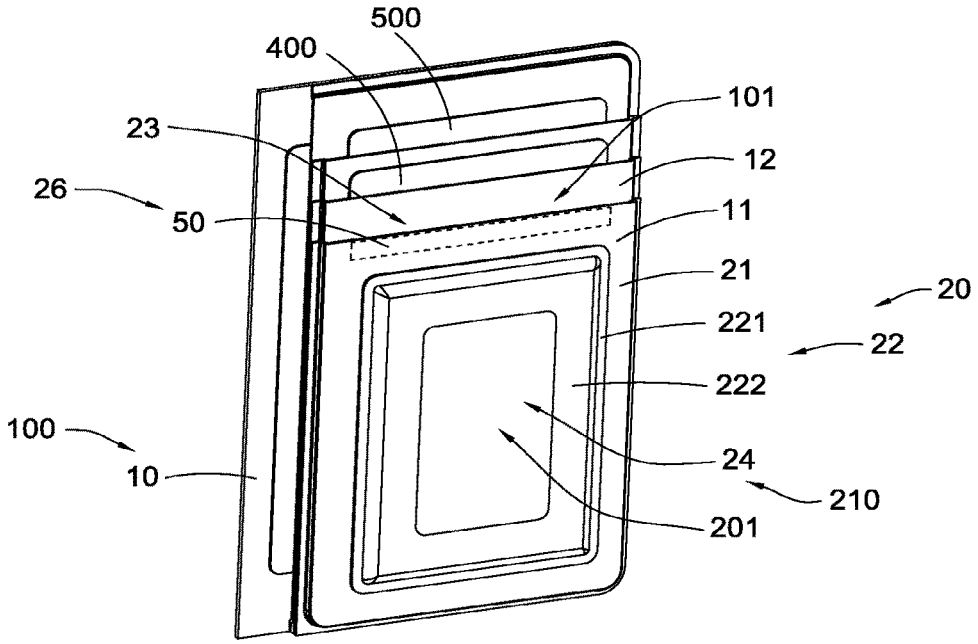
FIG. 31A is a perspective view of a wallet with an anti-lost card according to a ninteenth preferred embodiment of the present invention.
Figure 31B:
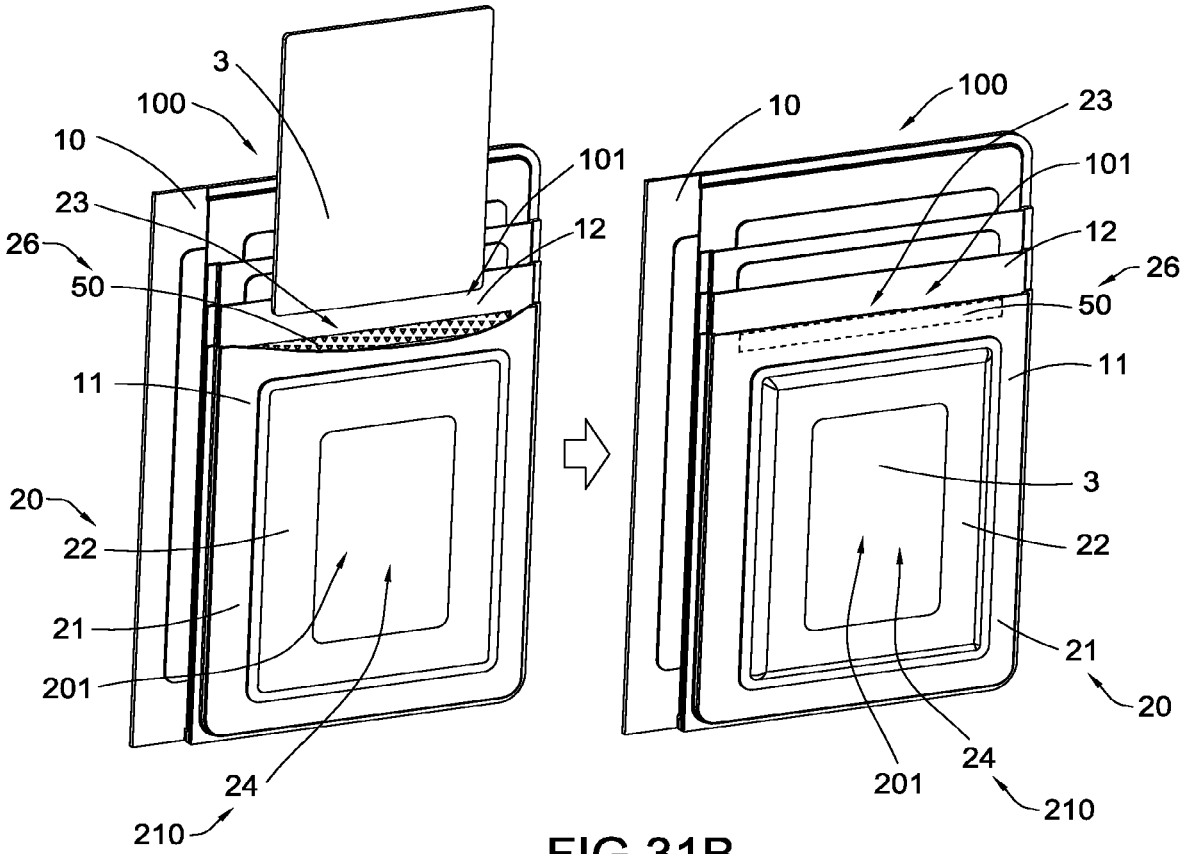
FIG. 31B is an exploded view of the wallet with an anti-lost card according to the above ninteenth preferred embodiment of the present invention shown in FIG. 31A.

Correspondingly, as shown in FIGS. 31A and 31B of the drawings, in a ninteenth preferred embodiment of the present invention, an interlayer space 101 is formed between the first partition layer 11 and the second partition layer 12, and there is a gap between the upper edge parts of the first partition layer 11 and the second partition layer 12, forming an opening of the interlayer space 101. The first partition layer 11 is used as the first pocket surface 21 of the accommodating pocket 20, and the outer edge part 221 of the second pocket surface 22 is sewn around the first pocket surface 21 which is also the first partition layer 11. The second pocket surface 22 can also be joined with the first pocket surface 21 in other ways, for example, the outer edge part 221 of the second pocket surface 22 is integrally formed with the first pocket surface 21, and the inner covering part 222 of the second pocket surface 22 is protruded from the first pocket surface 21. The first pocket surface 21, that is, the first partition layer 11, has an opening corresponding to the inner covering part 222 of the second pocket surface 22, and the size of the opening is larger than the size of the anti-lost card 3, so that the accommodating pocket 20 for the anti-lost card 3 is communicated to the interlayer space 101 formed between the first partition layer 11 and the second partition layer 12, and the opening of the interlayer space 101 formed between the first partition layer 11 and the second partition layer 12 is used as the pocket opening 23, so that the anti-lost card 3 can reach the opening of the first partition layer 11 from the pocket opening 23 and enter the accommodating pocket 20.

The wallet 100 with the accommodating pocket for the anti-lost card also comprises a switch control mechanism 26 installed at the pocket opening 23, i.e., between the first partition layer 11 and the second partition layer 12. The switch control mechanism 26 can be implemented as the VELCRO$^{SM}$ element 50, the zipper 40, the elastic band 30, etc. When the pocket opening 23 is in the first state, the hook surface layer 51 and the fleece surface layer 52 of the VELCRO$^{SM}$ element 50 are separated, and the pocket opening 23 opens accordingly. When the pocket opening 23 is in the second state, the hook surface layer 51 and the fleece surface layer 52 of the VELCRO$^{SM}$ element 50 come into contact and connect with each other, and the pocket opening 23 closes accordingly.

It should be understood that the switch control mechanism 26 can also be implemented as other structures, such as buttons, screws, threaded structures (for example, the internal thread is provided on the inner peripheral wall of the first pocket surface 21 and the external thread is arranged on the outer peripheral wall of the second pocket surface 22 corresponding to it), etc.

Figure 32A:
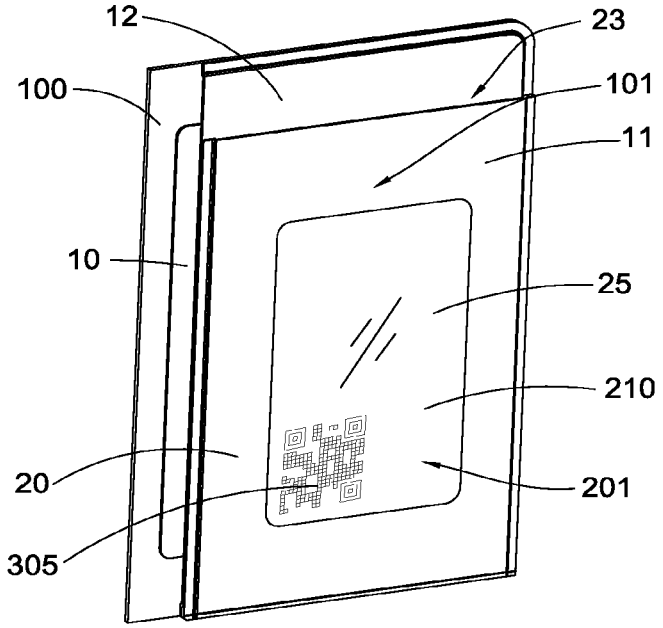
FIG. 32A is a perspective view of a wallet with an anti-lost card according to an alternative mode of the above ninteenth preferred embodiment of the present invention.
Figure 32B:
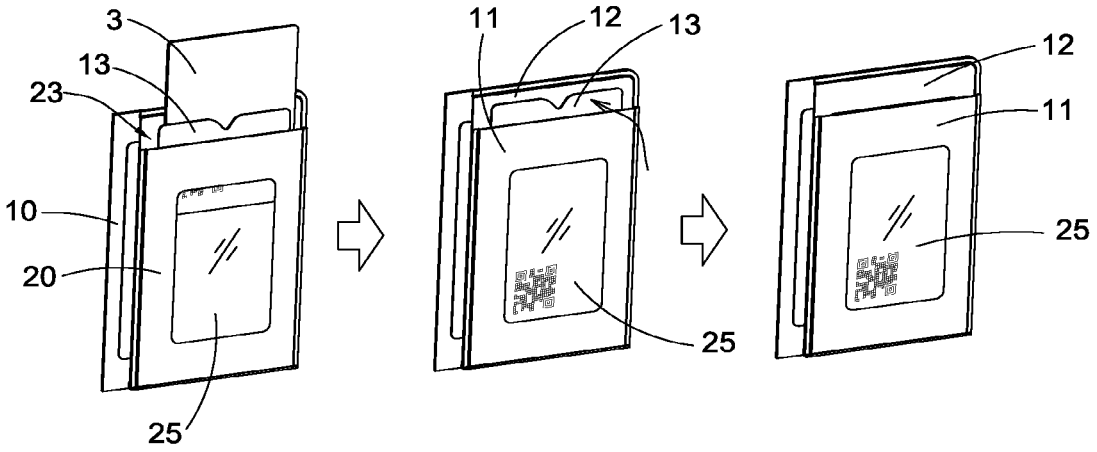
FIG. 32B is a schematic view illustrating the placing of the anti-lost card into the wallet according to the above alternative mode of the ninteenth preferred embodiment of the present invention shown in FIG. 32A.
Figure 33:
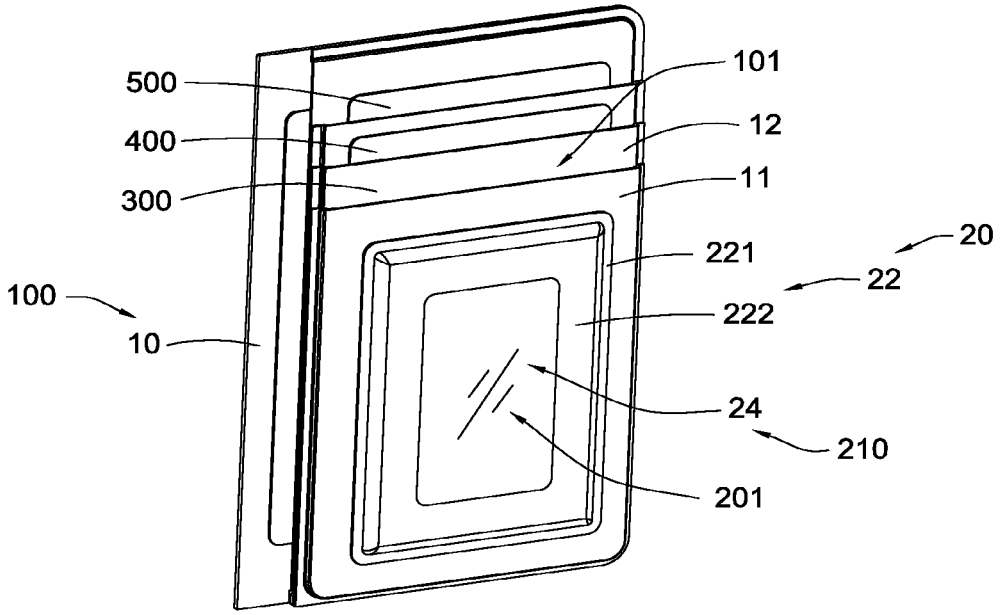
FIG. 33 is a perspective view of a wallet with an anti-lost card according to a twentieth preferred embodiment of the present invention.

As shown in FIGS. 32A and 32B, a wallet 100 with an anti-lost card 3 according to an alternative mode of the above ninteenth preferred embodiment of the present invention is illustrated. In this embodiment, an interlayer space 101 is formed between a first partition layer 11 and a second partition layer 12 to form the accommodating pocket 20 for storing the anti-lost card 3, and there is a gap between the upper edge parts of the first partition layer 11 and the second partition layer 12, so as to form a pocket opening 23 communicated to the interlayer space 101 to allow the anti-lost card 3 to enter and exit the interlayer space 101.

The first partition layer 11 can be a cover layer of the wallet body 11 at a front or back side of the wallet 100, and the second partition layer 12 can be an adjacent layer adjacent to the front layer. In addition, a visible window structure 210 which comprises a transparent cover 25 is provided on the first part partition layer 12, so that when the anti-lost card 3 is disposed into the interlayer space 101 between the first partition layer 11 and the second partition layer 12, a surface corresponding to the transparent cover 25 is exposed for the user to view the anti-lost card 3 from outside.

In this embodiment, the anti-lost card 3 comprises the identification mark 305 which can be a QR code that can be captured by a camera of an electronic device, so as to provide contact information of the owner such as telephone number of the owner, so as to allow a person to return the missing wallet 100 to the owner. And the identification mark 305 is visible through the transparent cover 25, so as to allow the person picking up the wallet 100 to easily obtain the contact information without taking out the anti-lost card 3 from the accommodating pocket 20.

In addition, the wallet body 10 further comprises a folding layer 13 connected to one of the first partition layer 11 and the second partition layer 12 at a position corresponding to the pocket opening 23. As shown in FIG. 32B, when the anti-lost card 3 is need to be placed into the interlayer space 101, the folding layer 13 is pulled and flipped out of the interlayer space 101, and then the anti-lost card 3 is disposed into the interlayer space 101, and finally, the folding layer 13 is folded back into the interlayer space 101 to cover an upper part of the anti-lost card 3, so that the anti-lost card 3 is not easy to slip off from the interlayer space 101 between the first partition layer 11 and the second partition layer 12.

In some embodiments of the present invention, the accommodating pocket 20 for the anti-lost card and the wallet body 10 are structurally independent from each other, and the accommodating pocket 20 for the anti-lost card 3 can be detachably assembled on the wallet body 10, which is convenient for replacing the anti-lost card 3, as shown in FIGS. 33 to 36. Specifically, the accommodating pocket 20 for the anti-lost card 3 comprises a first pocket surface 21 and a second pocket surface 22 which is opposite to the first pocket surface 21, the pocket surfaces 21 and 22 are structurally independent with the wallet body 10, i.e., they are not formed by a portion of the structure of the wallet body 10. A detachable connecting element 60 is provided between the first pocket surface 21 and the wallet body 10, which allows the accommodating pocket 20 for the anti-lost card 3 to be detachably assembled on the wallet body 10. In these embodiments, the accommodating pocket 20 for the anti-lost card 3 can be implemented as a fully enclosed pocket or as a pocket with an opening.

Figure 34:
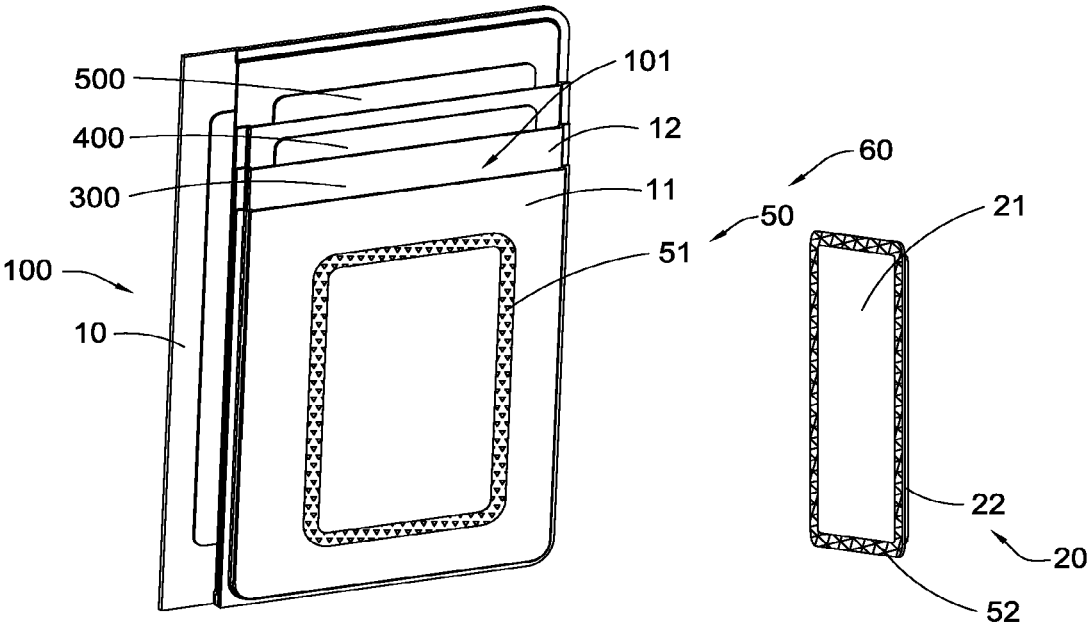
FIG. 34 is a perspective view of a wallet with accommodating pocket for anti-lost tag according to a twenty-first preferred embodiment of the present invention.

The accommodating pocket 20 for the anti-lost card 3 is detachably assembled to the wallet body 10 in various embodiments not limited to the present invention. In one example of the present invention, the connecting element 60 between the accommodating pocket 20 for the anti-lost card 3 and the wallet body 10 is implemented as the VELCRO$^{SM}$ element 50, as shown in FIG. 34. Correspondingly, in this preferred embodiment of the present invention, the wallet 100 with the accommodating pocket for the anti-lost card 3 also comprises a VELCRO$^{SM}$ element 50 installed between the accommodating pocket 20 and the wallet body 10, and the accommodating pocket 20 for the anti-lost card 3 is detachably assembled to the wallet body 10 through the Velcro element 50. The VELCRO$^{SM}$ 50 element comprises a hook surface layer 51 and a fleece surface layer 52, where the hook surface layer 51 is arranged on the first pocket surface 21 and the fleece surface layer 52 is disposed on the wallet body 10, or the hook surface layer 51 is disposed on the wallet body 10 and the fleece surface layer 52 is arranged on the first pocket surface 21.

In this example, the entire outer edge part 221 of the second pocket surface 22 is sewn to the first pocket surface 21. In another embodiment of the present invention, the accommodating pocket 20 for the anti-lost card 3 may also have a pocket opening 23 suitable for the anti-lost card 3 to enter and exit.

Figure 35:
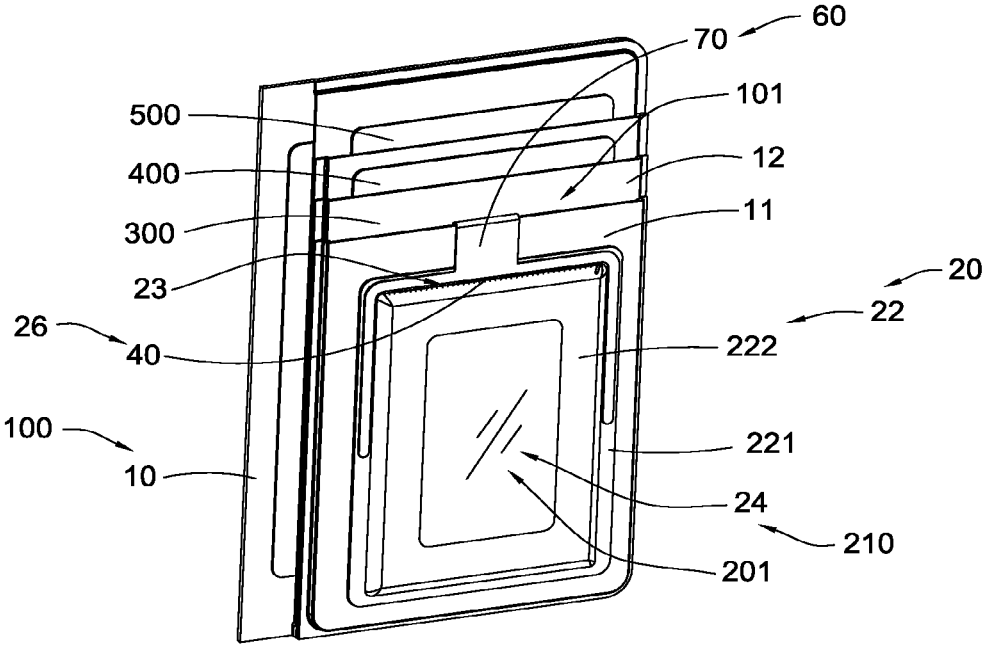
FIG. 35 is a perspective view of a wallet with an anti-lost card according to a twenty-second preferred embodiment of the present invention.
Figure 36:
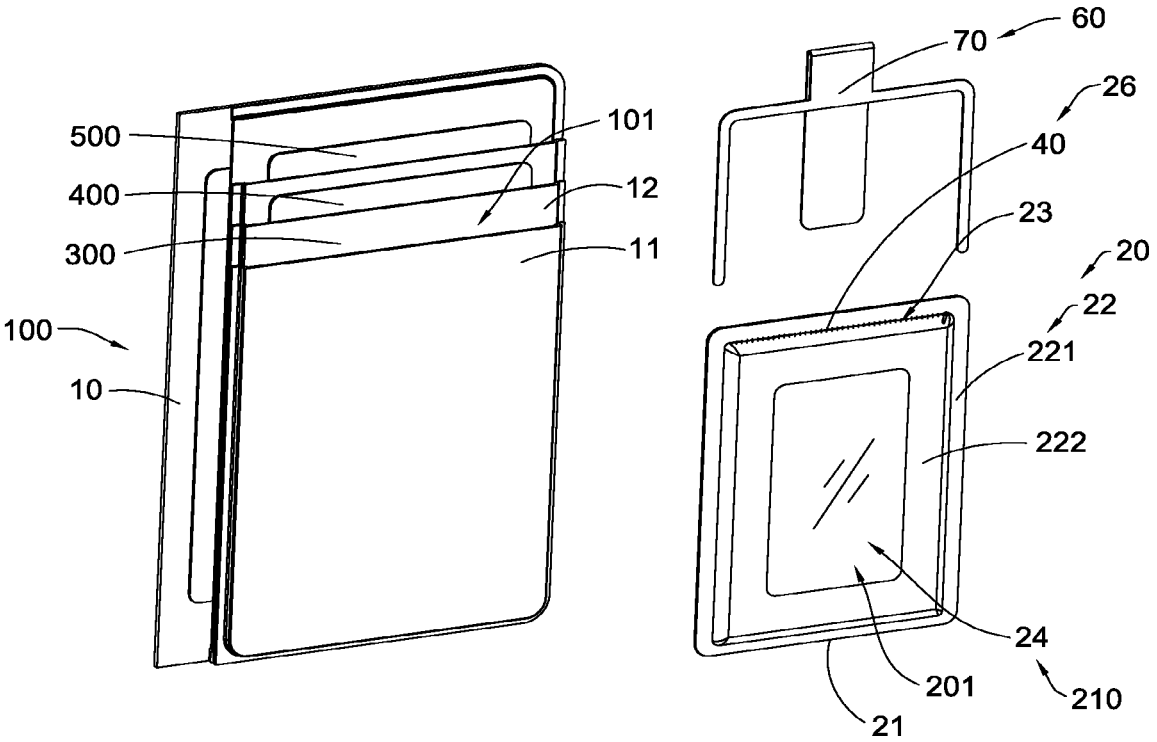
FIG. 36 is a perspective view of a wallet with accommodating pocket for anti-lost card according to the above twenty-second preferred embodiment of the present invention.

In a twenty-second preferred embodiment of the present invention, the connecting element 60 between the anti-lost card accommodating pocket 20 and the wallet body 10 is implemented as an elastic clip 70, as shown in FIGS. 35 and 36. Accordingly, in this example, the wallet 100 with the accommodating pocket 20 also comprises the elastic clip 70 installed between the accommodating pocket 20 and the wallet body 10, and the anti-lost card accommodating pocket 20 can be detachably assembled to the wallet body 10 through the elastic clip 70. The elastic clip 70 comprises a first elastic piece and a second elastic piece, and the accommodating pocket 20 is fixed to the first elastic piece. The first elastic piece and the second elastic piece are integrally connected, and an adjustable gap is formed between the first elastic piece and the second elastic piece. When the first elastic piece and the second elastic piece move away from each other, at least one layer of the sandwiched surface of the wallet body 10 can be clamped into the adjustable gap; when the first elastic piece and the second elastic piece move closer to each other, the size of the adjustable gap decreases, and the first elastic piece and the second elastic piece clamp the sandwiched surface tightly, so that the anti-lost card accommodating pocket 20 is installed on the wallet body 10. When the first elastic piece and the second elastic piece move away from each other, at least one layer of the sandwiched surface of the wallet body 10 can be detached from the adjustable gap, so that the anti-lost card accommodating pocket 20 is detached from the wallet body 10.

In this example, the accommodating pocket 20 for the anti-lost card 3 has a pocket opening 23, which is suitable for the anti-lost card 3 to enter and exit the accommodating pocket 20.

It should be understood that the accommodating pocket 20 for the anti-lost card 3 can also be detachably connected to the wallet body 10 in other ways, such as through straps, snap structures, threaded structures, etc., and is not limited to the present invention.

Figure 37:
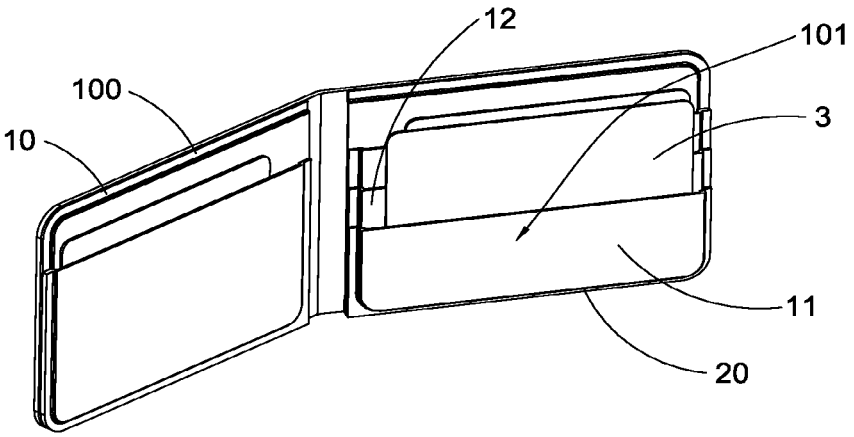
FIG. 37 is a perspective view of a wallet with an anti-lost card according to a twenty-third preferred embodiment of the present invention.

As shown in FIG. 37, a wallet 100 with an anti-lost card 3 according to a twenty-third preferred embodiment of the present invention is illustrated. In this embodiment, the wallet body 10 has a plurality of interlayer spaces 101 formed between two adjacent partition layers, and any one of the interlayer spaces 101 can be used for storing the anti-lost card 3. In other words, the anti-lost card 3 can be placed into one interlayer space 101 like the manner of placing the credit card or bank card into the interlayer space 101.

Figure 38:
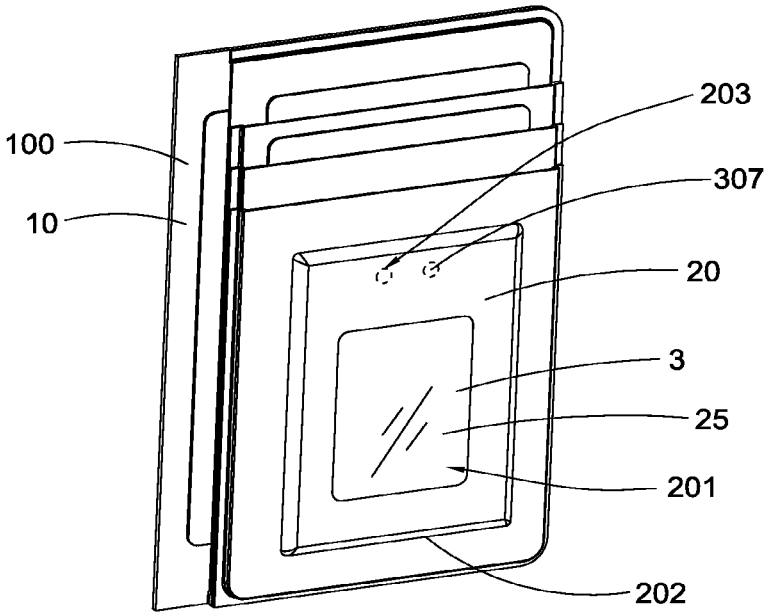
FIG. 38 is a perspective view of a wallet with an anti-lost card according to a twenty-fourth preferred embodiment of the present invention.
Figure 39:
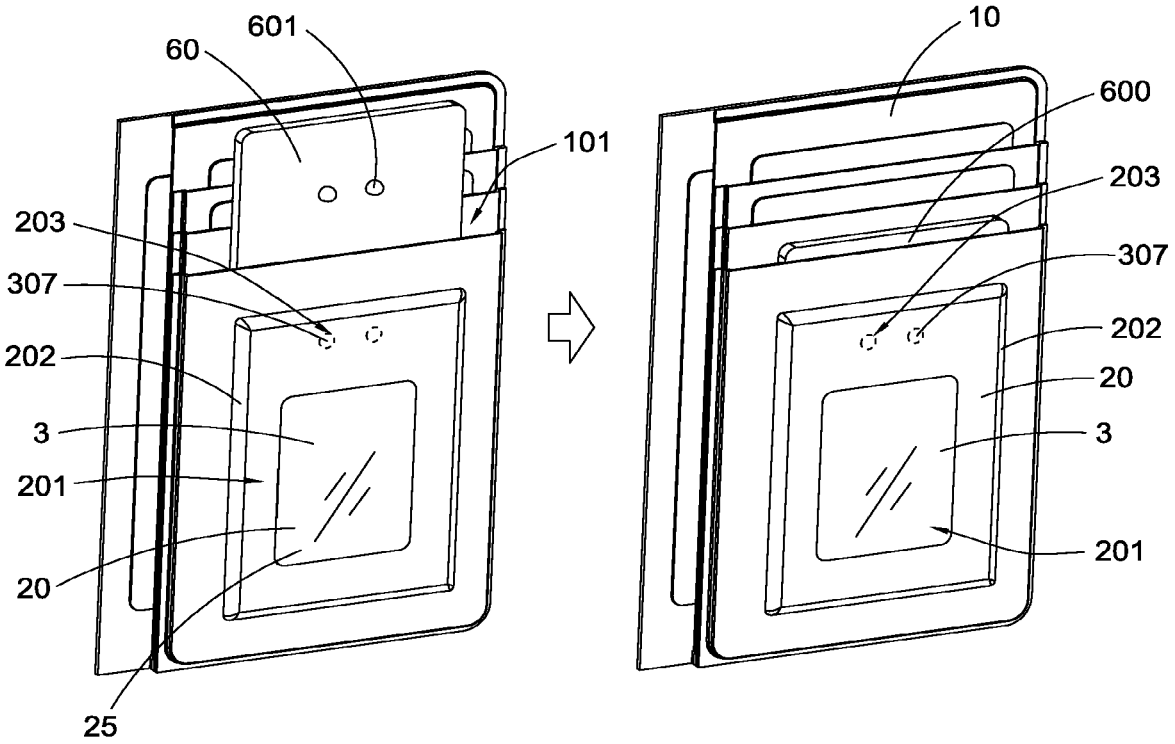
FIG. 39 is a schematic view illustrating the electrical charing of the anti-lost card of the wallet according to the above twenty-fourth preferred embodiment of the present invention.

Referring to FIGS. 38 and 39, a wallet 100 with an anti-lost card 3 according to a twenty-fourth preferred embodiment of the present invention is illustrated. The wallet 100 comprises a wallet body 10 and an accommodating pocket 20 connected to the wallet body 10, and the anti-lost card 3 is placed in the accommodating pocket 20 and is sealed in the accommodating pocket 20, so that the anti-lost card 3 is permanently fixed in the accommodating pocket 20.

In other words, in this embodiment, the anti-lost card 3 is a component of the wallet 100 and is not detachable, a surrounding edge 202 defining the accommodating space 201 of the accommodating pocket 20 is sealed and no opening is formed, so that it is impossible for the anti-lost card 3 to be detached from the accommodating pocket 20 during normal use of the wallet 100. A transparent 25 also can be provided on the accommodating pocket 20 for a user to view the anti-lost card 3 from outside.

In this embodiment, the anti-lost card 3 comprises has two electrical contacts 307 which are respectively electrically connected to the battery module 303, the accommodating pocket 20 has two holes 203 aligned with the two electrical contacts 307 to expose the two electrical contacts 307. Therefore, an electrical charging device 600 can have contact with the two electrical contacts 307 of the anti-lost card 3, so as to electrically charging the battery module 303 of the anti-lost card 3.

The wallet body 10 has an interlayer space 101 adjacent to the accommodating pocket 20, and the two holes 203 can be configured to be communicated to the interlayer space 101, so that as shown in FIG. 39, the electrical charging device 600 can be put into the interlayer space 101 so as to align electrical connecting ends 601 of the electrical charging device 600 with the two electrical contacts 307 of the anti-lost card 3 for electrically charging the battery module 303.

Alternatively, the electrical charging interface of the anti-lost card 3 can be accessed from outside, and the electrical charging interface also may be coupled to the electrical charging device 600 to achieve a wirelessly charging of the battery module 303.

It is worth mentioning that in this embodiment of the present invention, the solution for storing the anti-lost card 3 provided by the wallet 100 with the accommodating pocket 20 for the anti-lost card 3 can also be applied to other types of bags, such as computer bags, backpacks, handbags, etc. In other words, the accommodating pocket 20 for the anti-lost card 3 can be incorporated into other bag bodies in a manner similar to that of the wallet body 10, forming a receiving and storing bag with an accommodating pocket 20 for the anti-lost card 3.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A wallet, comprising:

a wallet body which comprises a first partition layer and a second partition layer, wherein said first partition layer has a front surface as a front surface of said wallet body and a rear surface overlapped with said second partition layer to define an interlayer space between said first partition layer and said second partition layer;

an accommodating pocket, having an accommodating space, formed on said front surface of said wallet body;

an anti-lost card which is disposed in said accommodating space of said accommodating pocket and retained on said front surface of said wallet body for positioning a location of said wallet body, wherein said accommodating pocket is integrally formed on said front surface of said wallet body, wherein said anti-lost card is permanently fixed and sealed in said accommodating pocket in front of said wallet body; and an electrically charging device, wherein said anti-lost card comprises two electrical contacts, wherein said accommodating pocket has two holes aligned with said two electrical contacts respectively for exposing two electrical contacts, wherein when said electrically charging device is received in said interlayer space of said wallet body, said electrical contacts of said anti-lost card are in contact with said electrically charging device through said holes of said accommodating pocket, such that said electrically charging device is arranged to electrically charge said anti-lost card.

2. The wallet according to claim 1, wherein said two holes are communicated between said interlayer space and said accommodating space, so as to allow the electrically charging device to be disposed in said interlayer space to electrically charge said anti-lost card.

3. A wallet, comprising:

a wallet body which comprises a first partition layer and a second partition layer wherein said first partition layer has a front surface as a front surface of said wallet body and a rear surface overlapped with said second partition layer to define an interlayer space between said first partition layer and said second partition layer;

an accommodating pocket, having an accommodating space, formed on said front surface of said wallet body;

an anti-lost card which is disposed in said accommodating space of said accommodating pocket and retained on said front surface of said wallet body for positioning a location of said wallet body;

wherein said accommodating pocket comprises a first pocket surface formed by as said front surface of said wallet body and a second pocket surface which is formed on said front surface of said wallet body and joined to said first pocket surface to form said accommodating space between said second pocket surface and said front surface of said wallet body for storing said anti-lost card.

4. The wallet according to claim 3, wherein said accommodating pocket has a pocket opening formed on said second pocket surface, and said pocket opening is arranged for allowing the anti-lost card to enter and exit said accommodating pocket, wherein said second pocket surface has a slit formed thereon as said pocket opening, wherein a length of said slit is larger than a length of said anti-lost card.

5. The wallet according to claim 4, further comprising a switch control mechanism which is disposed at said pocket opening to allow said pocket opening to be switched between a first state and a second state, wherein when said pocket opening is in said first state, the anti-lost card is allowed to enter and exit said accommodating pocket through said pocket opening, and when said pocket opening is in said second state, said anti-lost card is blocked from entering and exiting said accommodating pocket through said pocket opening.

6. The wallet according to claim 5, wherein said switch control mechanism comprises an elastic band which is disposed at said pocket opening, wherein when said pocket opening is in said first state, a size of said pocket opening expands, and when said pocket opening is in said second state, the size of said pocket opening contracts.

7. The wallet according to claim 6, wherein said second pocket surface comprises an inner covering part covering on said front surface of said wallet body, wherein said outer edge part is formed at an outer edge of said inner covering part.

8. The wallet according to claim 5, wherein said switch control mechanism comprises a zipper installed at said pocket opening, wherein said pocket opening is opened in said first state and closed in said second state.

9. The wallet according to claim 5, wherein said switch control mechanism comprises a hook element and a fleece element installed at said pocket opening.

10. The wallet according to claim 3, wherein said accommodating pocket has a pocket opening formed between said first pocket surface and an outer edge portion of said second pocket surface.

11. The wallet according to claim 10, wherein said wallet body comprises a folding layer which is pivotally coupled to said accommodating pocket at a position corresponding to said pocket opening, wherein said folding layer is pulled out of said accommodating space for allowing said anti-lost card to be disposed in said accommodating space through said pocket opening, and then said folding layer is covered on an upper part of said anti-lost card to prevent said anti-lost card to slip off from said accommodating space.

* * * * *